US010287663B2

(12) United States Patent
Na et al.

(10) Patent No.: US 10,287,663 B2
(45) **Date of Patent: *May 14, 2019**

(54) BULK NICKEL-PHOSPHORUS-SILICON GLASSES BEARING MANGANESE

(71) Applicants: Glassimetal Technology, Inc., Pasadena, CA (US); Apple Inc., Cupertino, CA (US)

(72) Inventors: Jong Hyun Na, Pasadena, CA (US); Danielle Duggins, Garden Grove, CA (US); Oscar Abarca, Anaheim, CA (US); Maximilien Launey, Pasadena, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 638 days.

This patent is subject to a terminal disclaimer.

(21) Appl. No.: 14/824,733

(22) Filed: Aug. 12, 2015

(65) Prior Publication Data

US 2016/0047023 A1 Feb. 18, 2016

Related U.S. Application Data

(60) Provisional application No. 62/078,242, filed on Nov. 11, 2014, provisional application No. 62/036,328, filed on Aug. 12, 2014.

(51) Int. Cl.

| | |
|---|---|
| ***C22C 45/04*** | (2006.01) |
| ***C22F 1/10*** | (2006.01) |
| ***C22C 45/02*** | (2006.01) |
| ***C22F 1/00*** | (2006.01) |
| ***C22C 1/00*** | (2006.01) |

(Continued)

(52) U.S. Cl.

CPC ..... *C22F 1/10* (2013.01); *C22C 1/002* (2013.01); *C22C 19/03* (2013.01); *C22C 19/058* (2013.01); *C22C 45/02* (2013.01); *C22C 45/04* (2013.01); *C22F 1/002* (2013.01)

(58) Field of Classification Search

None

See application file for complete search history.

(56) References Cited

U.S. PATENT DOCUMENTS

| | | | |
|---|---|---|---|
| 3,856,513 | A | 12/1974 | Chen et al. |
| 4,116,682 | A | 9/1978 | Polk et al. |
| 4,126,284 | A | 11/1978 | Ichikawa et al. |

(Continued)

FOREIGN PATENT DOCUMENTS

| | | |
|---|---|---|
| CN | 1354274 | 6/2002 |
| CN | 1653200 | 8/2005 |

(Continued)

OTHER PUBLICATIONS

U.S. Appl. No. 14/797,878, filed Jul. 13, 2015, Na et al.

(Continued)

*Primary Examiner* — George Wyszomierski

(74) *Attorney, Agent, or Firm* — Polsinelli PC

(57) ABSTRACT

The disclosure is directed to Ni—P—Si alloys bearing Mn and optionally Cr, Mo, Nb, and Ta that are capable of forming a metallic glass, and more particularly demonstrate critical rod diameters for glass formation greater than 1 mm and as large as 5 mm or larger.

20 Claims, 33 Drawing Sheets

(51) Int. Cl.

| | |
|---|---|
| ***C22C 19/03*** | (2006.01) |
| ***C22C 19/05*** | (2006.01) |

(56) References Cited

U.S. PATENT DOCUMENTS

| | | | |
|---|---|---|---|
| 4,144,058 | A | 3/1979 | Chen et al. |
| 4,152,144 | A | 5/1979 | Hasegawa et al. |
| 4,385,932 | A | 5/1983 | Inomata et al. |
| 4,385,944 | A | 5/1983 | Hasegawa |
| 4,582,536 | A | 4/1986 | Raybould |
| 4,892,628 | A | 1/1990 | Guilinger |
| 4,900,638 | A | 2/1990 | Emmerich |
| 4,968,363 | A | 11/1990 | Hashimoto et al. |
| 5,338,376 | A | 8/1994 | Liu et al. |
| 5,429,725 | A | 7/1995 | Thorpe et al. |
| 5,634,989 | A | 6/1997 | Hashimoto et al. |
| 6,004,661 | A | 12/1999 | Sakai et al. |
| 6,303,015 | B1 | 10/2001 | Thorpe et al. |
| 6,325,868 | B1 | 12/2001 | Kim et al. |
| 6,695,936 | B2 | 2/2004 | Johnson |
| 8,052,923 | B2 | 11/2011 | Langlet |
| 8,287,664 | B2 | 10/2012 | Brunner |
| 2005/0263216 | A1 | 12/2005 | Chin et al. |
| 2006/0213586 | A1 | 9/2006 | Kui |
| 2007/0175545 | A1 | 8/2007 | Urata et al. |
| 2009/0110955 | A1 | 4/2009 | Hartman et al. |
| 2012/0073710 | A1 | 3/2012 | Kim et al. |
| 2012/0168037 | A1 | 7/2012 | Demetriou et al. |
| 2013/0048152 | A1 | 2/2013 | Na et al. |
| 2013/0263973 | A1 | 10/2013 | Kurahashi et al. |
| 2014/0076467 | A1 | 3/2014 | Na et al. |
| 2014/0096873 | A1 | 4/2014 | Na et al. |
| 2014/0116579 | A1 | 5/2014 | Na et al. |
| 2014/0130942 | A1 | 5/2014 | Floyd et al. |
| 2014/0130945 | A1 | 5/2014 | Na et al. |
| 2014/0190593 | A1 | 7/2014 | Na et al. |
| 2014/0213384 | A1 | 7/2014 | Johnson et al. |
| 2014/0238551 | A1 | 8/2014 | Na et al. |
| 2015/0047755 | A1 | 2/2015 | Na et al. |
| 2015/0158126 | A1 | 6/2015 | Hartmann et al. |
| 2015/0159242 | A1 | 6/2015 | Na et al. |
| 2015/0176111 | A1 | 6/2015 | Na et al. |
| 2015/0197837 | A9 | 7/2015 | Schramm et al. |

FOREIGN PATENT DOCUMENTS

| | | |
|---|---|---|
| DE | 3929222 | 3/1991 |
| DE | 102011001783 | 10/2012 |
| DE | 102011001784 | 10/2012 |
| EP | 0014335 | 8/1980 |
| EP | 0161396 | 11/1985 |
| EP | 0260706 | 3/1988 |
| EP | 1077272 | 2/2001 |
| EP | 1108796 | 6/2001 |
| EP | 1522602 | 4/2015 |
| JP | 54-76423 | 6/1979 |
| JP | S55-148752 | 11/1980 |
| JP | S57-13146 | 1/1982 |
| JP | 63-079930 | 4/1988 |
| JP | 63-079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Habazaki et al., "Corrosion behaviour of amorphous Ni-Cr-Nb-P-B bulk alloys in 6M HCI solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni-Cr-P-B Metallic Glasses Produced by Melt-Spinning in Air," *Materials Transactions*, vol. 48, No. 12, 2007, pp. 3176-3180.

Park T.G. et al., "Development of new Ni-based amorphous alloys containing no. metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni-P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni-Cr-B-Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

Katagiri et al., "An attempt at preparation of corrosion-resistant bulk amorphous Ni-Cr-Ta-Mo-P-B alloys," Corrsion Science, vol. 43, No. 1, pp. 183-191, 2001.

Habazaki et al., "Preparation of corrosion-resistant amorphous Ni-Cr-P-B bulk alloys containing molybdenum and tantalum," *Material Science and Engineering*, A304-306, 2001, pp. 696-700.

Zhang et al., "The Corrosion Behavior of Amorphous Ni-Cr-P Alloys in Concentrated Hydrofluoric Acid," *Corrosion Science*, vol. 33, No. 10, pp. 1519-1528, 1992.

BULK NICKEL-PHOSPHORUS-SILICON GLASSES BEARING MANGANESE

CROSS-REFERENCE TO RELATED APPLICATIONS

The present application claims the benefit under 35 U.S.C. § 119(e) of U.S. Provisional Patent Application No. 62/036,328, entitled "Bulk Nickel-Phosphorus-Silicon Glasses Bearing Manganese," filed on Aug. 12, 2014, and U.S. Provisional Patent Application No. 62/078,242, entitled "Bulk Nickel-Phosphorus-Silicon Glasses Bearing Manganese," filed on Nov. 11, 2014, which are incorporated herein by reference in their entirety.

FIELD

The disclosure is directed to Ni—P—Si alloys bearing Mn, and optionally Cr, Mo, Nb, and Ta that are capable of forming a metallic glass, and more particularly metallic glass rods with diameters greater than 1 mm and as large as 3 mm or larger.

BACKGROUND

European Patent Application 0161393 by O'Handley (1981), entitled "Low Magnetostriction Amorphous Metal Alloys", discloses Ni—Co-based alloys bearing, among other elements, Mn, P, and Si, that are capable of forming ultra-thin magnetic objects that are partially amorphous. Specifically, all alloys that included Mn had to also include Co, as the objective of the invention was to achieve magnetic materials, and Co is the only element among those included that would make the partially amorphous material magnetic. The magnetic materials can only be formed in the form of ultra-thin ribbons, splats, wires, etc., as they require ultra-high cooling rates (on the order of $10^5$ K/s) to partially form the amorphous phase.

SUMMARY

The disclosure is directed to Ni—P—Si alloys bearing Mn and optionally Cr, Mo, Nb, and Ta that are capable of forming a metallic glass, and more particularly bulk metallic glass rods with diameters of at least 1 mm and as large as 3 mm or larger. The disclosure is also directed to metallic glasses formed of the alloys.

As will be clear to those of skill in the art, the disclosure is directed to metallic glasses having the same formula or elemental composition as described herein for alloys.

In one embodiment, the disclosure is directed to an alloy capable of forming a metallic glass represented by the following formula (subscripts denote atomic percentages):

$$Ni_{(100-a-b-c-d)}Mn_aX_bP_cSi_d \quad (1)$$

where:

a is between 0.25 and 12 b is up to 20 c is between 14 and 22 d is between 0.25 and 5 wherein X is selected from Cr, Mo, Nb, Ta, and combinations thereof.

In another embodiment, a is between 0.5 and 10.

In another embodiment, X is at least one of Cr and Mo, where the combined atomic concentration of Cr and Mo is up to 18 percent.

In another embodiment, X is at least one of Nb and Ta, where the combined atomic concentration of Nb and Ta is up to 6 percent.

In another embodiment, the c+d ranges from 16 to 24 percent.

In another embodiment, the c+d ranges from 18 to 22 percent.

In another embodiment, the c+d ranges from 16.5 to 22 percent.

In another embodiment, c is between 16 and 20.

In another embodiment, c is between 17 and 19.

In another embodiment, d is between 0.5 and 3.

In another embodiment, d is between 1 and 2.

In another embodiment, up to 50 atomic percent of Ni is substituted with Co.

In another embodiment, up to 30 atomic percent of Ni is substituted with Fe.

In another embodiment, up to 10 atomic percent of Ni is substituted with Cu.

In another embodiment, the alloy comprises Ge, V, Sn, W, Ru, Re, Pd, Pt, or combinations thereof at combined atomic concentration of up to 2 percent.

In yet another embodiment, the melt is fluxed with a reducing agent prior to rapid quenching.

In yet another embodiment, the fluxing agent is boron oxide.

In yet another embodiment, the melt temperature prior to quenching is at least 100° C. above the liquidus temperature of the alloy.

In another embodiment, the critical rod diameter of the alloy is at least 1 mm.

In yet another embodiment, the metallic glass is formed as an object having a lateral dimension of at least 1 mm.

In yet another embodiment, the melt temperature prior to quenching is at least 1100° C.

In yet another embodiment, a wire made of such metallic glass having a diameter of 1 mm can undergo macroscopic plastic deformation under bending load without fracturing catastrophically.

In another embodiment, b=0, a is greater than 2 and up to 9, c is between 16 and 20, and d is between 0.5 and 3.

In another embodiment, b=0, a is between 3 and 8.5, and the critical rod diameter of the alloy is at least 1 mm.

In another embodiment, b=0, a is between 5 and 8, and the critical rod diameter of the alloy is at least 2 mm.

In another embodiment, b=0, a is between 6 and 7, and the critical rod diameter of the alloy is at least 3 mm.

In another embodiment, b=0, c is between 15 and 21, and the critical rod diameter of the alloy is at least 1 mm.

In another embodiment, b=0, c is between 17 and 19, and the critical rod diameter of the alloy is at least 2 mm.

In another embodiment, b=0, c is between 17.5 and 18.5, and the critical rod diameter of the alloy is at least 3 mm.

In another embodiment, b=0, c+d is between 17 and 21.5, and the critical rod diameter of the alloy is at least 1 mm.

In another embodiment, b=0, c+d is between 18.5 and 20.5, and the critical rod diameter of the alloy is at least 2 mm.

In another embodiment, b=0, c+d is between 19 and 20, and the critical rod diameter of the alloy is at least 3 mm.

In another embodiment, b=0, d is between 0.25 and 3.5, and the critical rod diameter of the alloy is at least 1 mm.

In another embodiment, b=0, d is between 1 and 2, and the critical rod diameter of the alloy is at least 2 mm.

In another embodiment, b=0, d is between 1.25 and 1.75, and the critical rod diameter that is at least 3 mm.

In another embodiment, X comprises Mo and Nb.

In another embodiment, X comprises Mo and Nb, and the atomic concentration of Mo is between 0.5 and 4 atomic percent, and the critical rod diameter of the alloy is at least 1 mm.

In another embodiment, X comprises Mo and Nb, the atomic concentration of Mo is between 1 and 3.5 atomic percent, and the critical rod diameter of the alloy is at least 2 mm.

In another embodiment, X comprises Mo and Nb, the atomic concentration of Mo is between 1.5 and 3 atomic percent, and the critical rod diameter of the alloy is at least 3 mm.

In another embodiment, X comprises Mo and Nb, the atomic concentration of Nb is between 2 and 5.5 atomic percent, and the critical rod diameter of the alloy is at least 1 mm.

In another embodiment, X comprises Mo and Nb, the atomic concentration of Nb is between 2.5 and 5 atomic percent, and the critical rod diameter of the alloy is at least 2 mm.

In another embodiment, X comprises Mo and Nb, the atomic concentration of Nb is between 3 and 4.5 atomic percent, and the critical rod diameter of the alloy is at least 3 mm.

In another embodiment, X comprises Mo and Nb, a is between 0.25 and 5, and the critical rod diameter of the alloy is at least 1 mm.

In another embodiment, X comprises Mo and Nb, a is between 0.5 and 4, and the critical rod diameter of the alloy is at least 2 mm.

In another embodiment, X comprises Mo and Nb, a is between 1 and 3.5, and the critical rod diameter of the alloy is at least 3 mm.

In another embodiment, X comprises Mo and Nb, c is between 15 and 21, and the critical rod diameter of the alloy is at least 1 mm.

In another embodiment, X comprises Mo and Nb, c is between 17 and 19, and the critical rod diameter of the alloy is at least 2 mm.

In another embodiment, X comprises Mo and Nb, c is between 17.5 and 18.5, and the critical rod diameter of the alloy is at least 3 mm.

In another embodiment, X comprises Mo and Nb, d is between 0.25 and 3.5, and the critical rod diameter of the alloy is at least 1 mm.

In another embodiment, X comprises Mo and Nb, d is between 1 and 2, and the critical rod diameter of the alloy is at least 2 mm.

In another embodiment, X comprises Mo and Nb, d is between 1.25 and 1.75, and the critical rod diameter that is at least 3 mm.

In another embodiment, X comprises Mo and Nb, c+d is between 17 and 21.5, and the critical rod diameter of the alloy is at least 1 mm.

In another embodiment, X comprises Mo and Nb, c+d is between 18.5 and 20.5, and the critical rod diameter of the alloy is at least 2 mm.

In another embodiment, X comprises Mo and Nb, c+d is between 19 and 20, and the critical rod diameter of the alloy is at least 3 mm.

In another embodiment, X comprises Cr.

In another embodiment, X comprises Cr, a is between 1 and 7, and the critical rod diameter of the alloy is at least 1 mm.

In another embodiment, X comprises Cr, a is between 2 and 6, and the critical rod diameter of the alloy is at least 2 mm.

In another embodiment, X comprises Cr, a is between 2 and 5.5, and the critical rod diameter of the alloy is at least 3 mm.

In another embodiment, X comprises Cr, a is between 2 and 5, and the critical rod diameter of the alloy is at least 4 mm.

In another embodiment, X comprises Cr, b is between 5 and 15, and the critical rod diameter of the alloy is at least 1 mm.

In another embodiment, X comprises Cr, b is between 6 and 13, and the critical rod diameter of the alloy is at least 2 mm.

In another embodiment, X comprises Cr, b is between 7 and 11, and the critical rod diameter of the alloy is at least 3 mm.

In another embodiment, X comprises Cr, b is between 8 and 10, and the critical rod diameter of the alloy is at least 4 mm.

In another embodiment, X comprises Cr, c is between 15 and 21, and the critical rod diameter of the alloy is at least 1 mm.

In another embodiment, X comprises Cr, c is between 16 and 20, and the critical rod diameter of the alloy is at least 2 mm.

In another embodiment, X comprises Cr, c is between 16.5 and 19.5, and the critical rod diameter of the alloy is at least 3 mm.

In another embodiment, X comprises Cr, c is between 17 and 19, and the critical rod diameter of the alloy is at least 4 mm.

In another embodiment, X comprises Cr, c is between 17.5 and 18.5, and the critical rod diameter of the alloy is at least 5 mm.

In another embodiment, X comprises Cr, d is between 0.25 and 3, and the critical rod diameter of the alloy is at least 1 mm.

In another embodiment, X comprises Cr, d is between 1 and 2.5, and the critical rod diameter of the alloy is at least 2 mm.

In another embodiment, X comprises Cr, d is between 1 and 2.25, and the critical rod diameter of the alloy is at least 3 mm.

In another embodiment, X comprises Cr, d is between 1 and 2, and the critical rod diameter of the alloy is at least 4 mm.

In another embodiment, X comprises Cr, c+d is between 17 and 22, and the critical rod diameter of the alloy is at least 1 mm.

In another embodiment, X comprises Cr, c+d is between 17.25 and 21.25, and the critical rod diameter of the alloy is at least 2 mm.

In another embodiment, X comprises Cr, c+d is between 18.25 and 20.75, and the critical rod diameter of the alloy is at least 3 mm.

In another embodiment, X comprises Cr, c+d is between 18.75 and 20.25, and the critical rod diameter of the alloy is at least 4 mm.

In another embodiment, X comprises Cr, a is between 0.25 and 6, and the stability of the supercooled liquid against crystallization $\Delta T$ is at least 50° C.

In another embodiment, X comprises Cr, a is between 0.25 and 5, and the stability of the supercooled liquid against crystallization $\Delta T$ is at least 55° C.

In another embodiment, X comprises Cr, a is between 0.25 and 4.5, and the stability of the supercooled liquid against crystallization $\Delta T$ is at least 60° C.

In another embodiment, X comprises Cr, a is between 2 and 3.5, and the stability of the supercooled liquid against crystallization ΔT is at least 62.5° C.

In another embodiment, X comprises Cr, b is between 6 and 15, and the stability of the supercooled liquid against crystallization ΔT is at least 50° C.

In another embodiment, X comprises Cr, b is between 7 and 12, and the stability of the supercooled liquid against crystallization ΔT is at least 55° C.

In another embodiment, X comprises Cr, b is between 7.5 and 11.5, and the stability of the supercooled liquid against crystallization ΔT is at least 60° C.

In another embodiment, X comprises Cr, b is between 8 and 11, and the stability of the supercooled liquid against crystallization ΔT is at least 62.5° C.

In another embodiment, X comprises Cr, d is between 0.25 and 4, and the stability of the supercooled liquid against crystallization ΔT is at least 55° C.

In another embodiment, X comprises Cr, d is between 0.25 and 2.5, and the stability of the supercooled liquid against crystallization ΔT is at least 57.5° C.

In another embodiment, X comprises Cr, d is between 0.25 and 2, and the stability of the supercooled liquid against crystallization ΔT is at least 60° C.

In another embodiment, X comprises Cr, d is between 0.25 and 1.5, and the stability of the supercooled liquid against crystallization ΔT is at least 62.5° C.

In another embodiment, X comprises Cr, c+d is between 18 and 21, and the stability of the supercooled liquid against crystallization ΔT is at least 50° C.

In another embodiment, X comprises Cr, c+d is between 18 and 20.5, and the stability of the supercooled liquid against crystallization ΔT is at least 52.5° C.

In another embodiment, X comprises Cr, c+d is between 18.25 and 20.25, and the stability of the supercooled liquid against crystallization ΔT is at least 57.5° C.

In another embodiment, X comprises Cr, c+d is between 18.5 and 20, and the stability of the supercooled liquid against crystallization ΔT is at least 60° C.

In another embodiment, X comprises Cr, c+d is between 18.5 and 19.5, and the stability of the supercooled liquid against crystallization ΔT is at least 62.5° C.

The disclosure is also directed to metallic glass alloy compositions $Ni_{77}Mn_{3.5}P_{18}Si_{1.5}$, $Ni_{75.5}Mn_5P_{18}Si_{1.5}$, $Ni_{74.5}Mn_6P_{18}Si_{1.5}$, $Ni_{74}Mn_{6.5}P_{18}Si_{1.5}$, $Ni_{73.5}Mn_7P_{18}Si_{1.5}$, $Ni_{72.5}Mn_8P_{18}Si_{1.5}$, $Ni_{74}Mn_{6.5}P_{19}Si_{0.5}$, $Ni_{74}Mn_{6.5}P_{18.5}Si_1$, $Ni_{74}Mn_{6.5}P_{18.25}Si_{1.25}$, $Ni_{74}Mn_{6.5}P_{17.5}Si_2$, $Ni_{74}Mn_{6.5}P_{17}Si_{2.5}$, $Ni_{74}Mn_{6.5}P_{16.5}Si_3$, $Ni_{75.38}Mn_{6.62}P_{16.16}Si_{1.34}$, $Ni_{75.38}Mn_{6.62}P_{16.62}Si_{1.38}$, $Ni_{74.92}Mn_{6.58}P_{17.08}Si_{1.42}$, $Ni_{74.46}Mn_{6.54}P_{17.54}Si_{1.46}$, $Ni_{73.54}Mn_{6.46}P_{18.46}Si_{1.54}$, $Ni_{73.08}Mn_{6.42}P_{18.92}Si_{1.58}$, $Ni_{72.62}Mn_{6.38}P_{19.38}Si_{1.62}$, $Ni_{72.5}Mo_4Nb_4P_{18}Si_{1.5}$, $Ni_{72.5}Mo_{3.5}Nb_4Mn_{0.5}P_{18}Si_{1.5}$, $Ni_{72.5}Mo_3Nb_4Mn_1P_{18}Si_{1.5}$, $Ni_{72.5}Mo_{2.5}Nb_4Mn_{1.5}P_{18}Si_{1.5}$, $Ni_{72.5}Mo_2Nb_4Mn_2P_{18}Si_{1.5}$, $Ni_{72.5}Mo_{1.5}Nb_4Mn_{2.5}P_{18}Si_{1.5}$, $Ni_{72.5}Mo_1Nb_4Mn_3P_{18}Si_{1.5}$, $Ni_{72.5}Mo_{0.5}Nb_4Mn_{3.5}P_{18}Si_{1.5}$, $Ni_{72.5}Nb_4Mn_4P_{18}Si_{1.5}$, $Ni_{72.5}Mo_1Nb_5Mn_2P_{18}Si_{1.5}$, $Ni_{72.5}Mo_{1.5}Nb_{4.5}Mn_2P_{18}Si_{1.5}$, $Ni_{72.5}Mo_{2.5}Nb_{3.5}Mn_2P_{18}Si_{1.5}$, $Ni_{72.5}Mo_3Nb_3Mn_2P_{18}Si_{1.5}$, $Ni_{72.5}Mo_{3.5}Nb_{2.5}Mn_2P_{18}Si_{1.5}$, $Ni_{74.5}Mo_{2.5}Nb_{3.5}P_{18}Si_{1.5}$, $Ni_{74}Mo_{2.5}Nb_{3.5}Mn_{0.5}P_{18}Si_{1.5}$, $Ni_{73.5}Mo_{2.5}Nb_{3.5}Mn_1P_{18}Si_{1.5}$, $Ni_{73}Mo_{2.5}Nb_{3.5}Mn_{1.5}P_{18}Si_{1.5}$, $Ni_{72}Mo_{2.5}Nb_{3.5}Mn_{2.5}P_{18}Si_{1.5}$, $Ni_{71.5}Mo_{2.5}Nb_{3.5}Mn_3P_{18}Si_{1.5}$, $Ni_{71}Mo_{2.5}Nb_{3.5}Mn_{3.5}P_{18}Si_{1.5}$, $Ni_{71.5}Cr_6Mn_3P_{18}Si_{1.5}$, $Ni_{70.5}Cr_7Mn_3P_{18}Si_{1.5}$, $Ni_{69}Cr_{8.5}Mn_3P_{18}Si_{1.5}$, $Ni_{68.5}Cr_9Mn_3P_{18}Si_{1.5}$, $Ni_{68}Cr_{9.5}Mn_3P_{18}Si_{1.5}$, $Ni_{67.5}Cr_{10}Mn_3P_{18}Si_{1.5}$, $Ni_{66.5}Cr_{11}Mn_3P_{18}Si_{1.5}$, $Ni_{65.5}Cr_{12}Mn_3P_{18}Si_{1.5}$, $Ni_{64.5}Cr_{13}Mn_3P_{18}Si_{1.5}$, $Ni_{63.5}Cr_{14}Mn_3P_{18}Si_{1.5}$, $Ni_{69.5}Cr_{9.5}Mn_{1.5}P_{18}Si_{1.5}$, $Ni_{69}Cr_{9.5}Mn_2P_{18}Si_{1.5}$, $Ni_{68.5}Cr_{9.5}Mn_{2.5}P_{18}Si_{1.5}$, $Ni_{67.5}Cr_{9.5}Mn_{3.5}P_{18}Si_{1.5}$, $Ni_{67}Cr_{9.5}Mn_4P_{18}Si_{1.5}$, $Ni_{66.5}Cr_{9.5}Mn_{4.5}P_{18}Si_{1.5}$, $Ni_{66}Cr_{9.5}Mn_5P_{18}Si_{1.5}$, $Ni_{65.5}Cr_{9.5}Mn_{5.5}P_{18}Si_{1.5}$, $Ni_{65}Cr_{9.5}Mn_6P_{18}Si_{1.5}$, $Ni_{67.5}Cr_{9.5}Mn_{3.5}P_{19}Si_{0.5}$, $Ni_{67.5}Cr_{9.5}Mn_{3.5}P_{18.5}Si_1$, $Ni_{67.5}Cr_{9.5}Mn_{3.5}P_{17.5}Si_2$, $Ni_{67.5}Cr_{9.5}Mn_{3.5}P_{17}Si_{2.5}$, $Ni_{67.5}Cr_{9.5}Mn_{3.5}P_{16.5}Si_3$, $Ni_{69.18}Cr_{9.74}Mn_{3.58}P_{16.15}Si_{1.35}$, $Ni_{68.76}Cr_{9.68}Mn_{3.56}P_{16.62}Si_{1.38}$, $Ni_{68.34}Cr_{9.62}Mn_{3.54}P_{17.08}Si_{1.42}$, $Ni_{67.92}Cr_{9.56}Mn_{3.52}P_{17.54}Si_{1.46}$, $Ni_{67.71}Cr_{9.53}Mn_{3.51}P_{17.77}Si_{1.48}$, $Ni_{67.29}Cr_{9.47}Mn_{3.49}P_{18.23}Si_{1.52}$, $Ni_{67.08}Cr_{9.44}Mn_{3.48}P_{18.46}Si_{1.54}$, $Ni_{66.66}Cr_{9.38}Mn_{3.46}P_{18.92}Si_{1.58}$, $Ni_{66.24}Cr_{9.32}Mn_{3.44}P_{19.38}Si_{1.62}$, and $Ni_{65.82}Cr_{9.26}Mn_{3.42}P_{19.85}Si_{1.65}$.

The disclosure is further directed to a metallic glass having any of the above formulas and/or formed of any of the foregoing alloys.

Additional embodiments and features are set forth in part in the description that follows, and in part will become apparent to those skilled in the art upon examination of the specification or may be learned by the practice of the embodiments discussed herein. A further understanding of the nature and advantages of certain embodiments may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
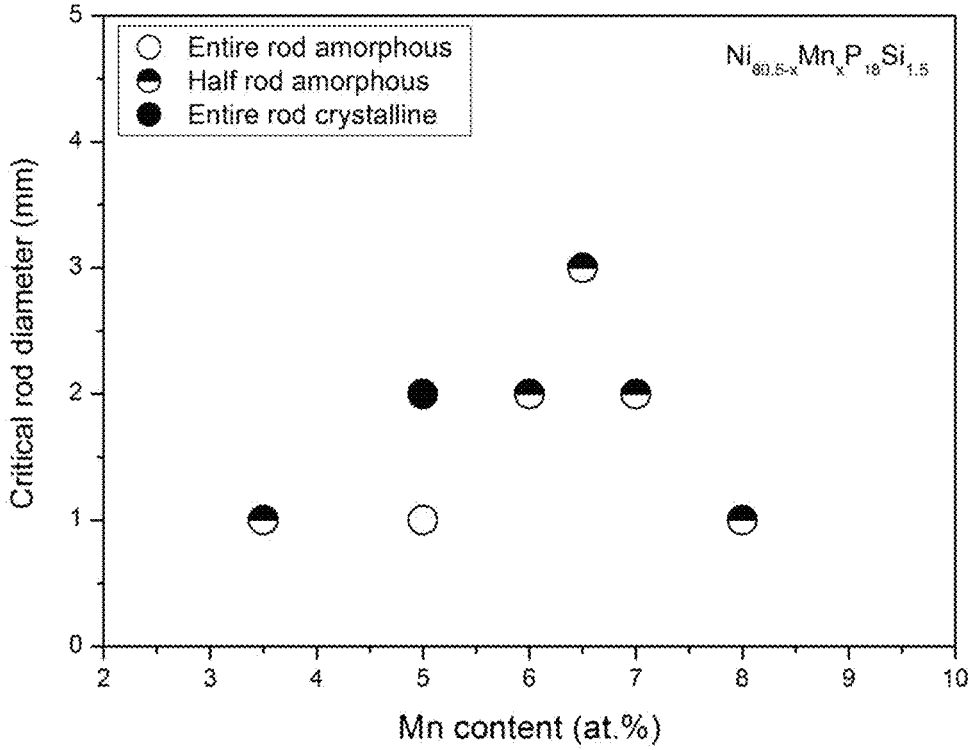
FIG. 1 provides a plot showing the effect of substituting Ni with Mn on the glass-forming ability of $Ni_{80.5-x}Mn_xP_{18}Si_{1.5}$ in accordance with embodiments of the disclosure.

The disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses formed of the disclosed alloys described herein.

In the disclosure it was discovered that B-free Ni—Mn—P—Si alloys that may also contain Cr, Mo, Nb, and Ta are capable of forming metallic glasses.

Definitions

In the disclosure, "B-free alloy" refers to an alloy that contains B up to atomic fractions that are consistent with incidental impurity. In some embodiments, alloys in accordance with the disclosure contain B in atomic concentrations of less than 0.1 percent. In other embodiments, alloys in accordance with the disclosure contain B in atomic concentrations of less than 0.05 percent. In yet other embodiments, alloys in accordance with the disclosure contain B in atomic concentrations of less than 0.01 percent.

In the disclosure, the glass-forming ability of each alloy is quantified by the "critical rod diameter," defined as the largest rod diameter in which the amorphous phase (i.e. the metallic glass) can be formed when processed by a method of water quenching a quartz tube having 0.5 mm thick walls containing a molten alloy.

A "critical cooling rate," which is defined as the cooling rate required to avoid crystallization and form the amorphous phase of the alloy (i.e. the metallic glass), determines the critical rod diameter. The lower the critical cooling rate of an alloy, the larger its critical rod diameter. The critical cooling rate $R_c$ in K/s and critical rod diameter $d_c$ in mm are related via the following approximate empirical formula:

$$R_c=1000/d_c^2 \quad \text{Eq. (2)}$$

According to Eq. (2), the critical cooling rate for an alloy having a critical rod diameter of about 3 mm, as in the case of the alloys according to embodiments of the disclosure, is only about $10^2$ K/s.

Generally, three categories are known in the art for identifying the ability of a metal alloy to form glass (i.e. to bypass the stable crystal phase and form an amorphous phase). Metal alloys having critical cooling rates in excess of $10^{12}$ K/s are typically referred to as non-glass formers, as it is physically impossible to achieve such cooling rates over a meaningful thickness (i.e. at least 1 micrometer). Metal alloys having critical cooling rates in the range of $10^5$ to $10^{12}$ K/s are typically referred to as marginal glass formers, as they are able to form glass over thicknesses ranging from 1 to 100 micrometers according to Eq. (2). Metal alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of a metallic alloy is, to a large extent, dependent on the composition of the alloy. The compositional ranges for alloys capable of forming marginal glass formers are considerably broader than those for forming bulk glass formers.

In the disclosure, the stability of the supercooled liquid against crystallization is defined as the difference between the crystallization temperature $T_x$ and the glass-transition temperature $T_g$, $\Delta T=T_x-T_g$, as measured by scanning calorimetry at heating rate of 20° C./min.

Example Alloy System 1: Ni—Mn—P—Si

In one embodiment of the disclosure, Ni-based alloys with a Mn content of between 0.5 and 10 atomic percent, a P content of between 16 and 21 atomic percent, and a Si content of between 0.5 and 3 atomic percent are capable of forming a metallic glass. In another embodiment, alloys with a Mn content of about 6 to 7 atomic percent, P content of about 17.5 to 18.5 atomic percent, and Si content of about 1 to 2 atomic percent, demonstrate a critical rod diameter of at least 3 mm.

Figure 2:
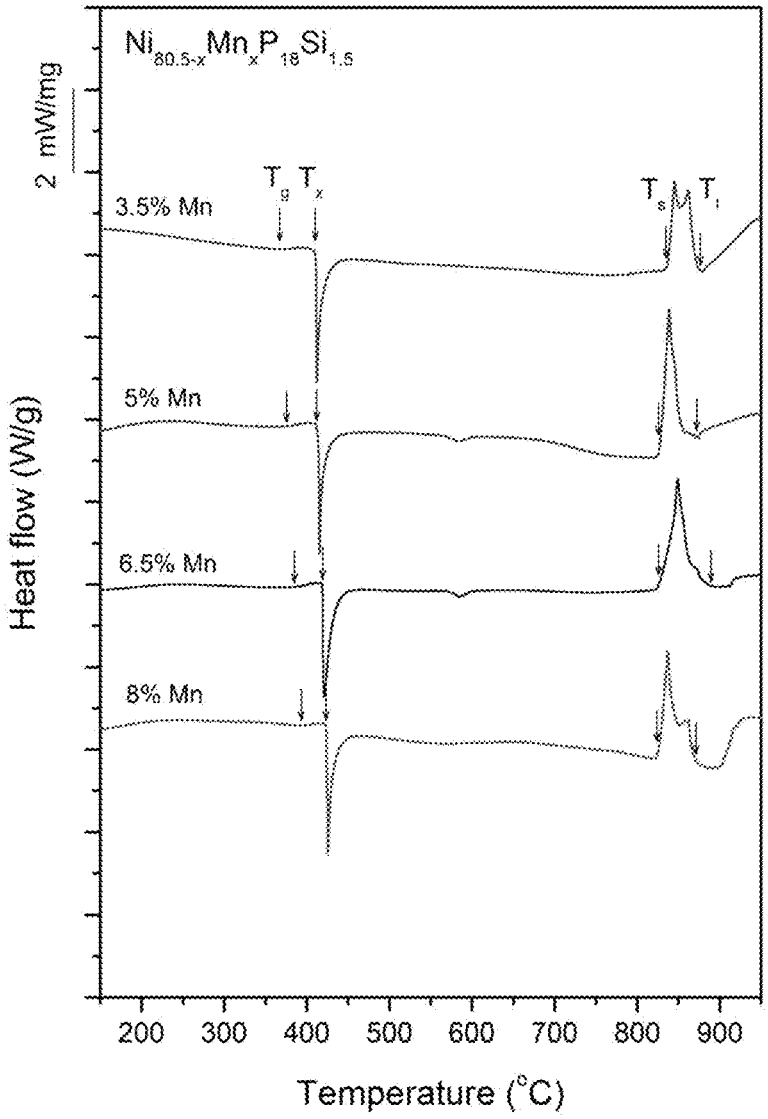
FIG. 2 provides a plot showing calorimetry scans for sample metallic glasses $Ni_{80.5-x}Mn_xP_{18}Si_{1.5}$ in accordance with embodiments of the disclosure. Arrows from left to right designate the glass-transition, crystallization, solidus, and liquidus temperatures, respectively.

Sample metallic glasses (Samples 1-6), in accordance with embodiments of the disclosure, showing the effect of substituting Ni with Mn, according to the formula $Ni_{80.5-x}Mn_xP_{18}Si_{1.5}$, are presented in Table 1 and FIG. 1. As shown, when the Mn atomic concentration x is between 3 and 8.5 percent, the critical rod diameter is at least 1 mm. More specifically, when the Mn atomic concentration x is at between 6 and 7 percent, the critical rod diameter is 2 to 3 mm. Differential calorimetry scans for the sample metallic glasses in which Ni is substituted with Mn are presented in FIG. 2.

TABLE 1

Sample alloys demonstrating the effect of increasing the Mn atomic concentration at the expense of Ni on the glass-forming ability of Ni—Mn—P—Si alloys

| Sample | Composition | Critical Rod Diameter [mm] |
|---|---|---|
| 1 | $Ni_{77}Mn_{3.5}P_{18}Si_{1.5}$ | 1 |
| 2 | $Ni_{75.5}Mn_5P_{18}Si_{1.5}$ | 1 |
| 3 | $Ni_{74.5}Mn_6P_{18}Si_{1.5}$ | 2 |
| 4 | $Ni_{74}Mn_{6.5}P_{18}Si_{1.5}$ | 3 |
| 5 | $Ni_{73.5}Mn_7P_{18}Si_{1.5}$ | 2 |
| 6 | $Ni_{72.5}Mn_8P_{18}Si_{1.5}$ | 1 |

Figure 3:
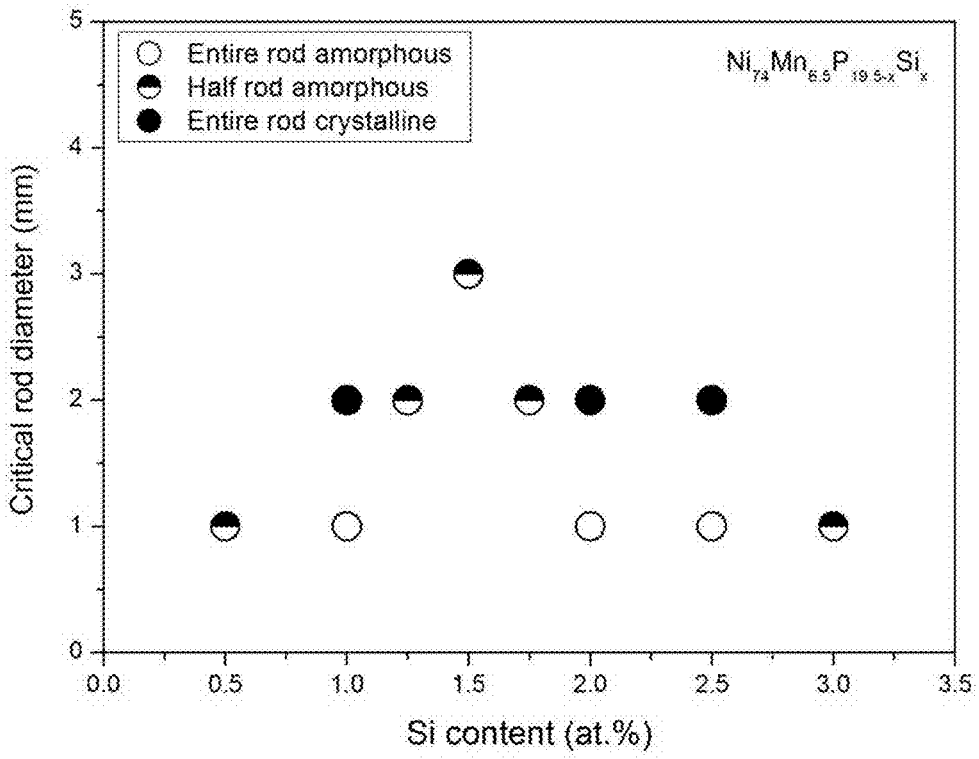
FIG. 3 provides a plot showing the effect of substituting P with Si on the glass-forming ability of $Ni_{74}Mn_{6.5}P_{19.5-x}Si_x$ alloys in accordance with embodiments of the disclosure.
Figure 4:
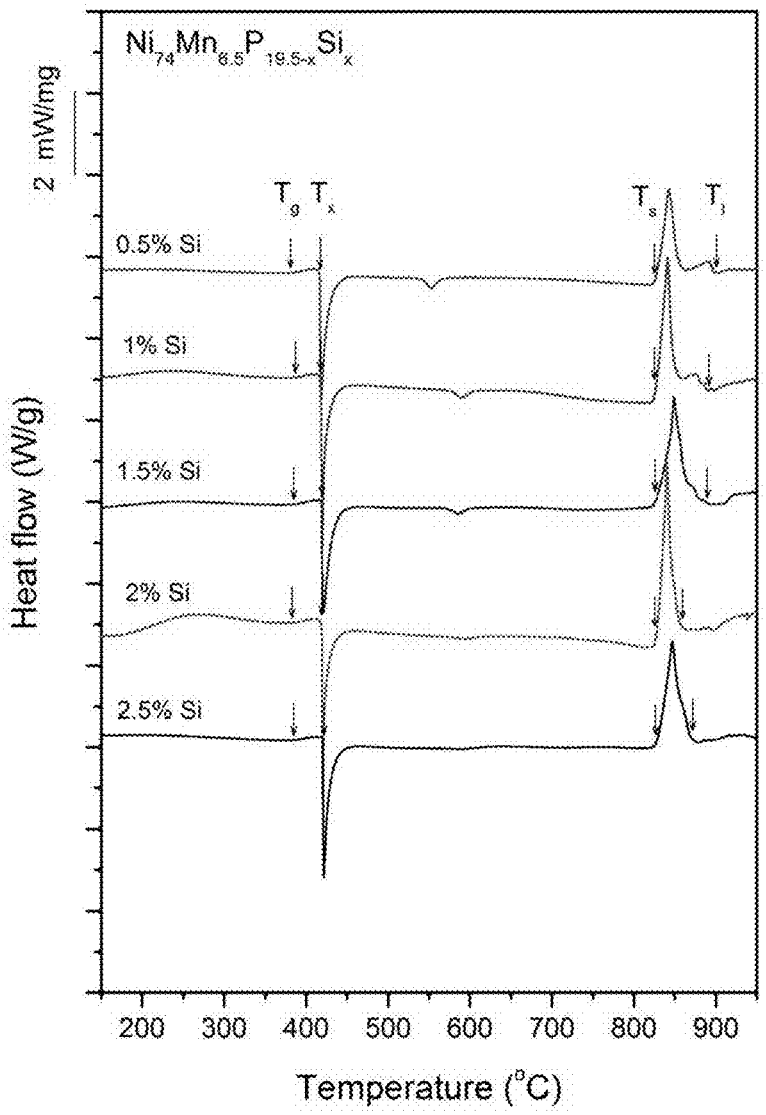
FIG. 4 provides a plot showing calorimetry scans for sample amorphous alloys $Ni_{74}Mn_{6.5}P_{19.5-x}Si_x$ in accordance with embodiments of the disclosure. Arrows from left to right designate the glass-transition, crystallization, solidus, and liquidus temperatures, respectively.

Sample metallic glasses (Samples 4 and 7-13) showing the effect of substituting P with Si, according to the formula $Ni_{74}Mn_{6.5}P_{19.5-x}Si_x$, in accordance with embodiments of the disclosure, are presented in Table 2 and FIG. 3. As shown, when the Si atomic concentration x is between 0.25 and 3.5 percent, the critical rod diameter is at least 1 mm. When the Si atomic concentration x is between 1 and 2 percent, the critical rod diameter is 2 to 3 mm. Differential calorimetry scans for several sample amorphous alloys, in accordance with embodiments of the disclosure, in which P is substituted with Si are presented in FIG. 4.

TABLE 2

Sample alloys demonstrating the effect of increasing the Si atomic concentration at the expense of P on the glass-forming ability of Ni—Mn—P—Si Alloys

| Sample | Composition | Critical Rod Diameter [mm] |
|---|---|---|
| 7 | $Ni_{74}Mn_{6.5}P_{19}Si_{0.5}$ | 1 |
| 8 | $Ni_{74}Mn_{6.5}P_{18.5}Si_1$ | 1 |
| 9 | $Ni_{74}Mn_{6.5}P_{18.25}Si_{1.25}$ | 2 |
| 4 | $Ni_{74}Mn_{6.5}P_{18}Si_{1.5}$ | 3 |
| 10 | $Ni_{74}Mn_{6.5}P_{17.75}Si_{1.75}$ | 2 |
| 11 | $Ni_{74}Mn_{6.5}P_{17.5}Si_2$ | 1 |
| 12 | $Ni_{74}Mn_{6.5}P_{17}Si_{2.5}$ | 1 |
| 13 | $Ni_{74}Mn_{6.5}P_{16.5}Si_3$ | 1 |

Figure 5:
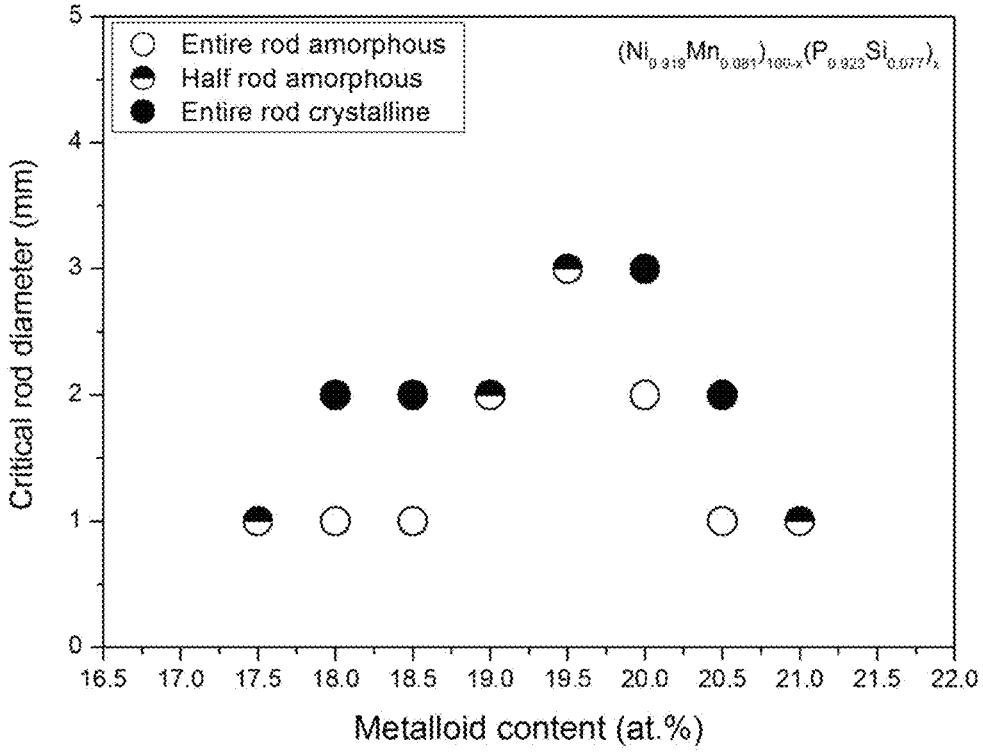
FIG. 5 provides a plot showing the effect of varying the metal to metalloid ratio, according to the formula $(Ni_{0.919}Mn_{0.081})_{100-x}(P_{0.923}Si_{0.077})_x$ in accordance with embodiments of the disclosure.
Figure 6:
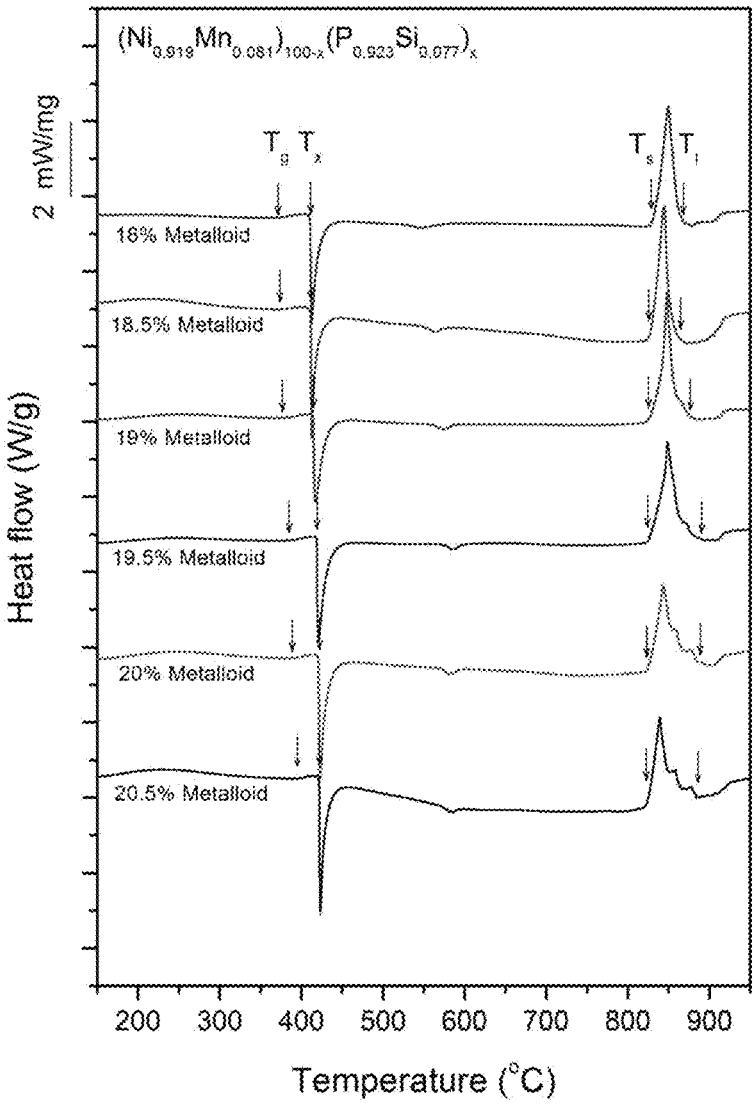
FIG. 6 provides a plot showing calorimetry scans for sample amorphous alloys $(Ni_{0.919}Mn_{0.081})_{100-x}(P_{0.923}B_{0.077})_x$ in accordance with embodiments of the disclosure. Arrows from left to right designate the glass-transition, crystallization, solidus, and liquidus temperatures, respectively.

Sample amorphous alloys (Samples 4 and 14-20), in accordance with embodiments of the disclosure, showing the effect of varying the metal to metalloid ratio, according to the formula $(Ni_{0.919}Mn_{0.081})_{100-x}(P_{0.923}Si_{0.077})_x$, are presented in Table 3 and FIG. 5. As shown, when the metalloid atomic concentration is between 17 and 21.5 percent, the critical rod diameter is at least 1 mm. When the metalloid atomic concentration x is between 18.75 and 19.5, the critical rod diameter ranges from 2 to 3 mm. Differential calorimetry scans for several sample amorphous alloys, in accordance with embodiments of the disclosure, in which the metal to metalloid ratio is varied are presented in FIG. 6.

TABLE 3

Sample amorphous alloys demonstrating the effect of increasing the total metalloid concentration at the expense of metals on the glass-forming ability of Ni—Mn—P—Si alloys

| Sample | Composition | Critical Rod Diameter [mm] |
|---|---|---|
| 14 | $Ni_{75.38}Mn_{6.62}P_{16.16}Si_{1.34}$ | 1 |
| 15 | $Ni_{75.38}Mn_{6.62}P_{16.62}Si_{1.38}$ | 1 |
| 16 | $Ni_{74.92}Mn_{6.58}P_{17.08}Si_{1.42}$ | 1 |
| 17 | $Ni_{74.46}Mn_{6.54}P_{17.54}Si_{1.46}$ | 2 |
| 4 | $Ni_{74}Mn_{6.5}P_{18}Si_{1.5}$ | 3 |
| 18 | $Ni_{73.54}Mn_{6.46}P_{18.46}Si_{1.54}$ | 2 |
| 19 | $Ni_{73.08}Mn_{6.42}P_{18.92}Si_{1.58}$ | 1 |
| 20 | $Ni_{72.62}Mn_{6.38}P_{19.38}Si_{1.62}$ | 1 |

Figure 7:
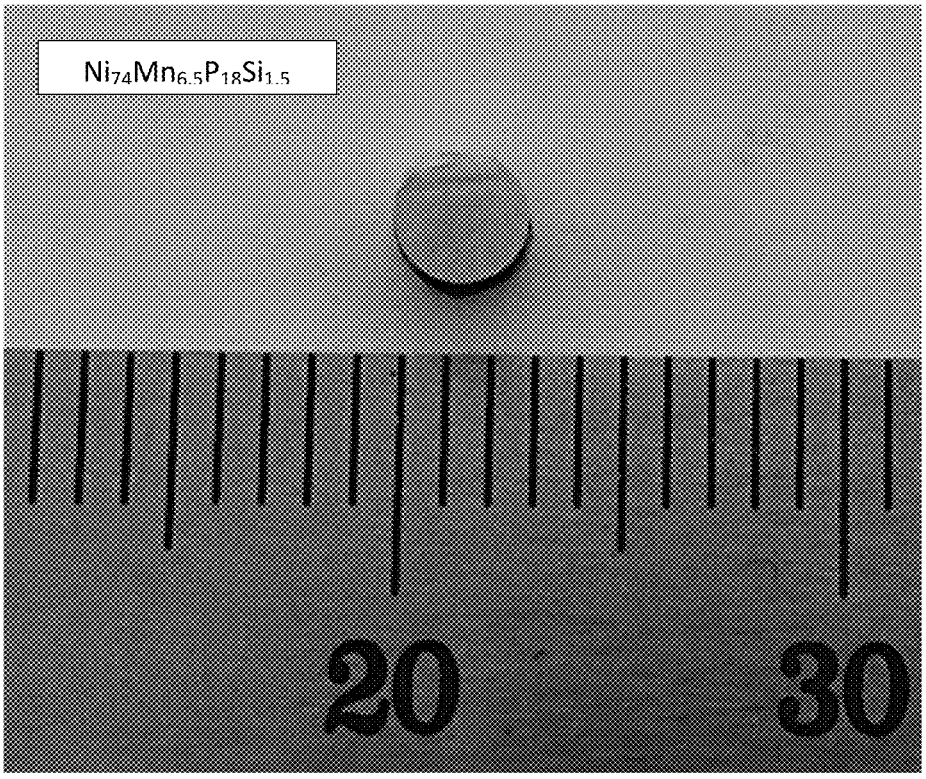
FIG. 7 provides an optical image of a 3 mm metallic glass rod of example alloy $Ni_{74}Mn_{6.5}P_{18}Si_{1.5}$ in accordance with an embodiment of the disclosure.
Figure 8:
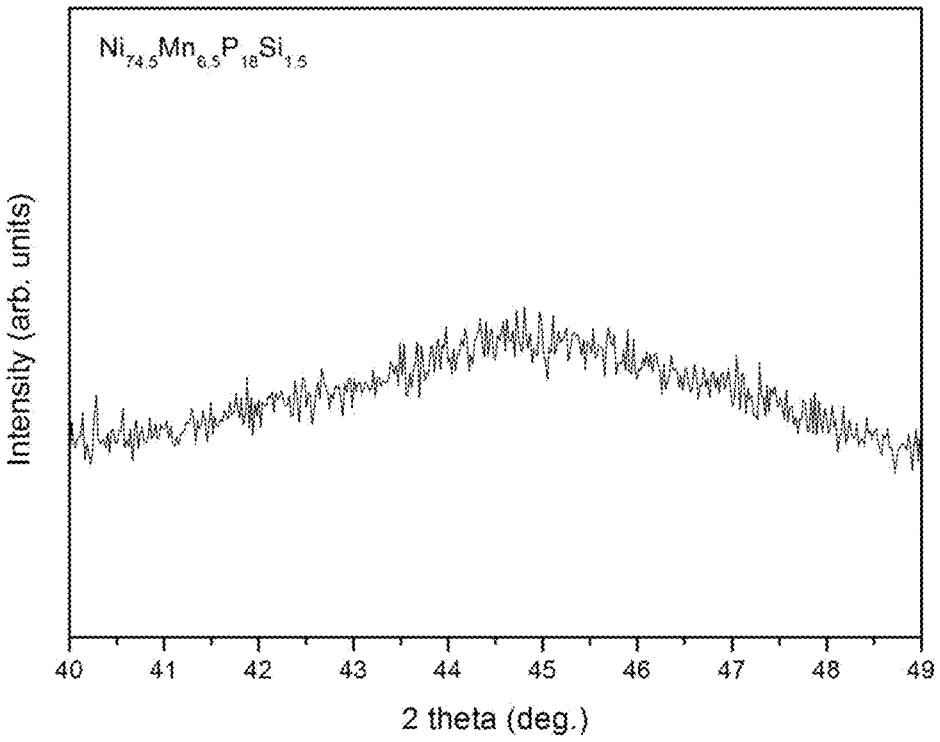
FIG. 8 provides an x-ray diffractogram verifying the amorphous structure of a 3 mm metallic glass rod of example alloy $Ni_{74}Mn_{6.5}P_{18}Si_{1.5}$ in accordance with an embodiment of the disclosure.

An image of a 3 mm metallic glass rod, in accordance with embodiments of the disclosure, of example alloy $Ni_{74}Mn_{6.5}P_{18}Si_{1.5}$ is presented in FIG. 7. An x-ray diffractogram verifying the amorphous structure of a 3 mm metallic glass rod of example alloy $Ni_{74}Mn_{6.5}P_{18}Si_{1.5}$ is shown in FIG. 8.

Figure 9:
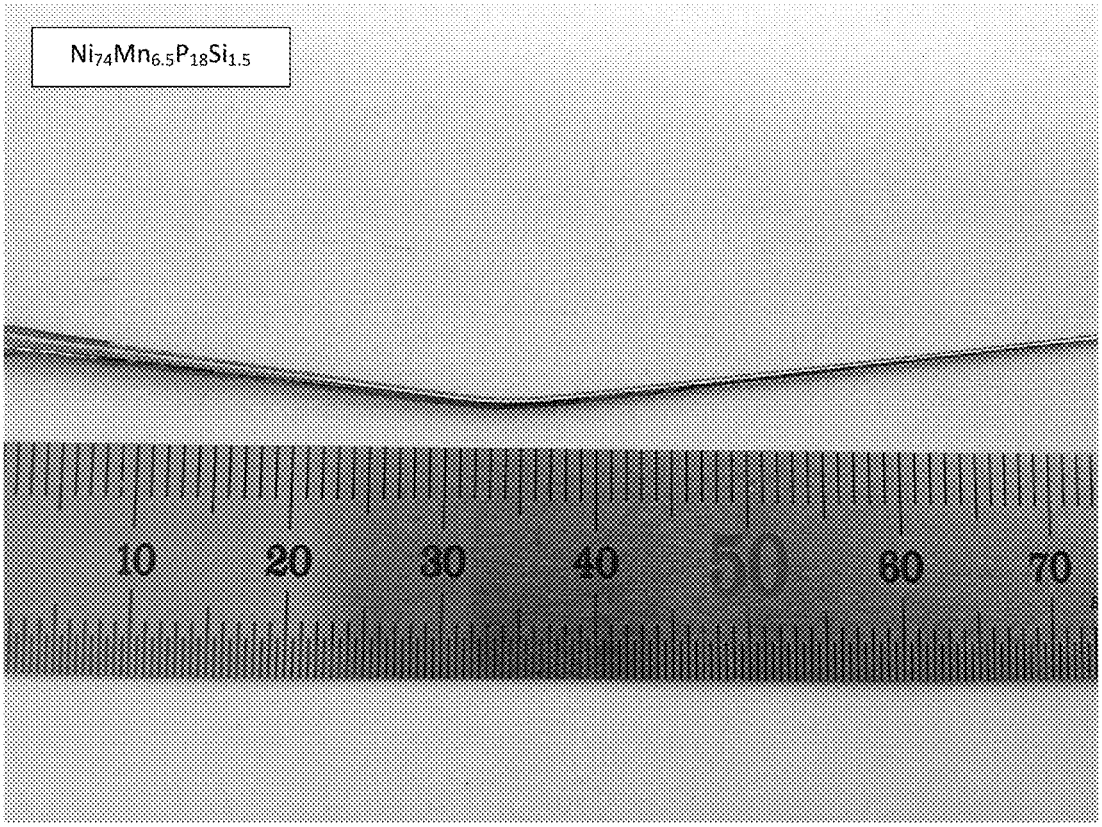
FIG. 9 provides an optical image of a plastically bent 1 mm metallic glass rod of example alloy $Ni_{74}Mn_{6.5}P_{18}Si_{1.5}$ in accordance with an embodiment of the t disclosure.

Lastly, the metallic glasses according to the disclosure exhibit a remarkable bending ductility. Specifically, under an applied bending load, the metallic glasses are capable of undergoing plastic bending in the absence of fracture for diameters up to at least 1 mm. Optical images of amorphous plastically bent rods at 1 mm diameter section of sample metallic glass $Ni_{74}Mn_{6.5}P_{18}Si_{1.5}$ are presented in FIG. 9.

Example Alloy System 2:
Ni—Mo—Nb—Mn—P—Si

In one embodiment of the disclosure, Ni-based alloys with a Mo content of between 0.5 and 4 atomic percent, a Nb content of between 2 and 5.5 atomic percent, a Mn content of between 0.25 and 5 atomic percent, a P content of between 16 and 21 atomic percent, and a Si content of between 0.5 and 3 atomic percent have a critical rod diameter of at least 1 mm. In another embodiment, Ni-based alloys with a Mo content of between 2 and 3 atomic percent, a Nb content of between 3 and 4 atomic percent, a Mn content of between 1 and 2 atomic percent, a P content of between 17 and 19 atomic percent, and a Si content of between 1 and 2 atomic percent have a critical rod diameter of at least 5 mm or larger.

Figure 10:
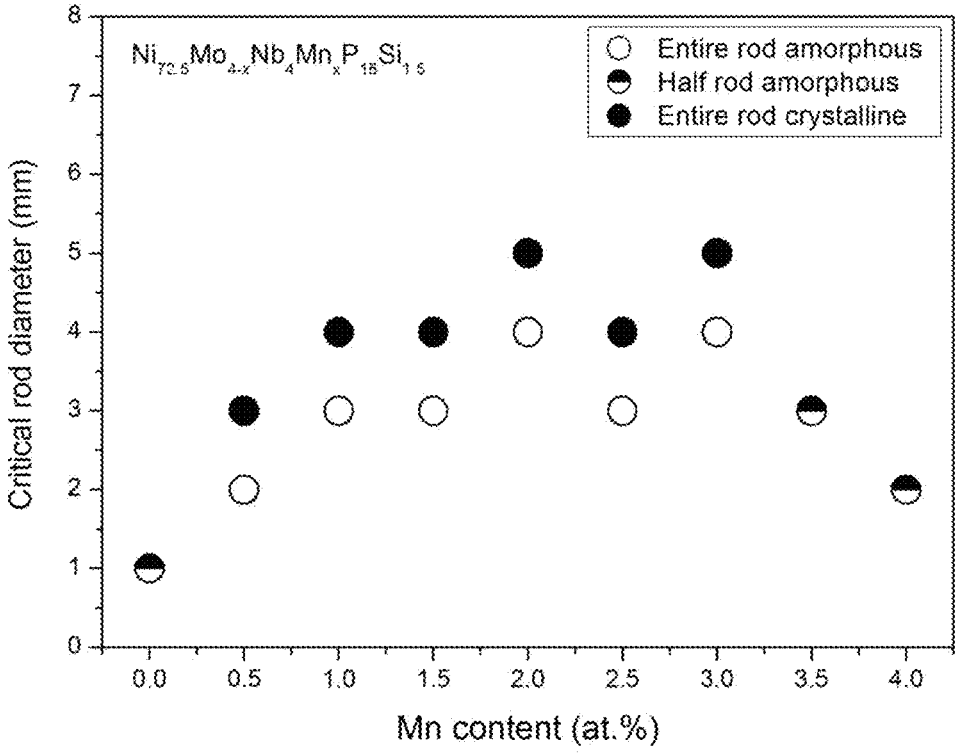
FIG. 10 provides a plot showing the effect of substituting Mo with Mn on the glass-forming ability of $Ni_{72.5-x}Mo_{4-x}Nb_4Mn_xP_{18}Si_{1.5}$ alloys in accordance with embodiments of the disclosure.
Figure 11:
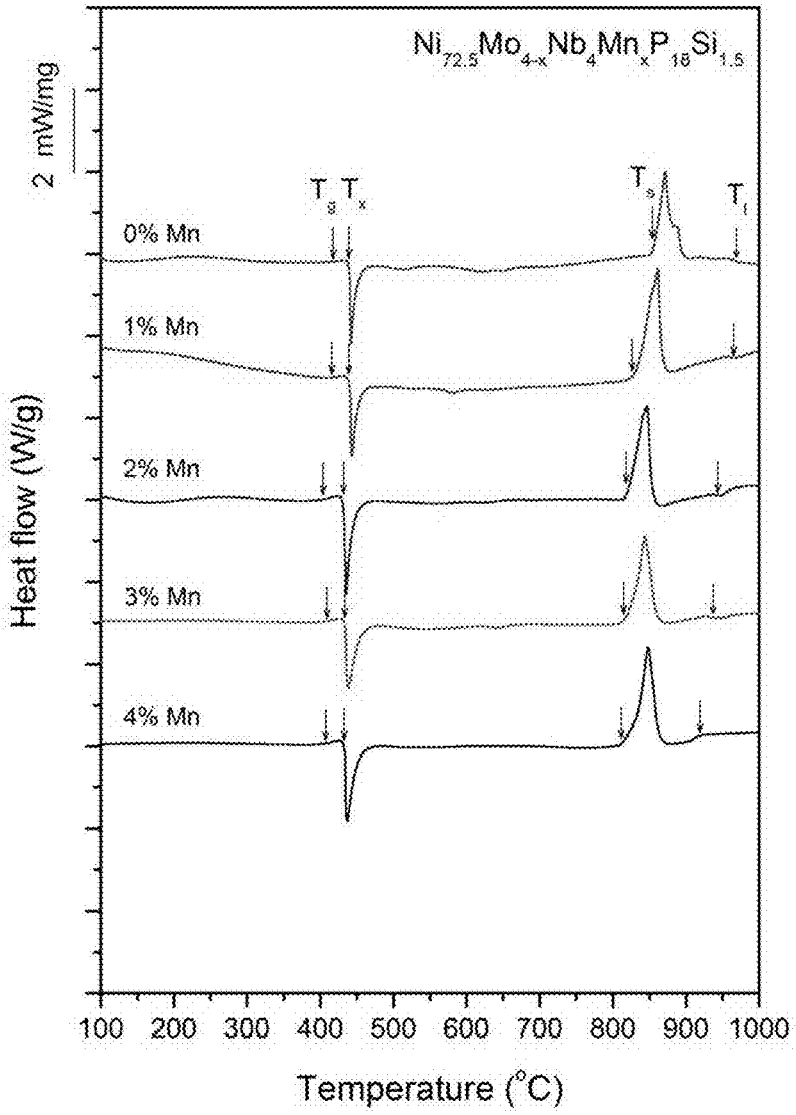
FIG. 11 provides a plot showing calorimetry scans for sample metallic glasses $Ni_{72.5-x}Mo_{4-x}Nb_4Mn_xP_{18}Si_{1.5}$ in accordance with embodiments of the disclosure. Arrows from left to right designate the glass-transition, crystallization, solidus, and liquidus temperatures, respectively.

Sample metallic glasses (Samples 21-29) showing the effect of substituting Mo with Mn, according to the formula $Ni_{72.5-x}Mo_{4-x}Nb_4Mn_xP_{18}Si_{1.5}$, are presented in Table 4 and FIG. 10. As shown, when the Mn atomic concentration x is between 0.25 and 5 percent, the critical rod diameter is at least 1 mm. When the Mn atomic concentration x is between 0.5 and 4 percent, the critical rod diameter is at least 2 mm, and when the Mn atomic concentration x is between 1 and 3.5 percent, the critical rod diameter is at least 3 mm. Differential calorimetry scans for sample metallic glasses in which Mo is substituted with Mn are presented in FIG. 11.

TABLE 4

Sample metallic glasses demonstrating the effect of increasing the Mn atomic concentration at the expense of Mo on the glass-forming ability of Ni—Mo—Nb—Mn—P—Si alloys

| Sample | Composition | Critical Rod Diameter [mm] |
|---|---|---|
| 21 | $Ni_{72.5}Mo_4Nb_4P_{18}Si_{1.5}$ | 1 |
| 22 | $Ni_{72.5}Mo_{3.5}Nb_4Mn_{0.5}P_{18}Si_{1.5}$ | 2 |
| 23 | $Ni_{72.5}Mo_3Nb_4Mn_1P_{18}Si_{1.5}$ | 3 |
| 24 | $Ni_{72.5}Mo_{2.5}Nb_4Mn_{1.5}P_{18}Si_{1.5}$ | 3 |
| 25 | $Ni_{72.5}Mo_2Nb_4Mn_2P_{18}Si_{1.5}$ | 4 |
| 26 | $Ni_{72.5}Mo_{1.5}Nb_4Mn_{2.5}P_{18}Si_{1.5}$ | 3 |
| 27 | $Ni_{72.5}Mo_1Nb_4Mn_3P_{18}Si_{1.5}$ | 4 |
| 28 | $Ni_{72.5}Mo_{0.5}Nb_4Mn_{3.5}P_{18}Si_{1.5}$ | 3 |
| 29 | $Ni_{72.5}Nb_4Mn_4P_{18}Si_{1.5}$ | 2 |

Figure 12:
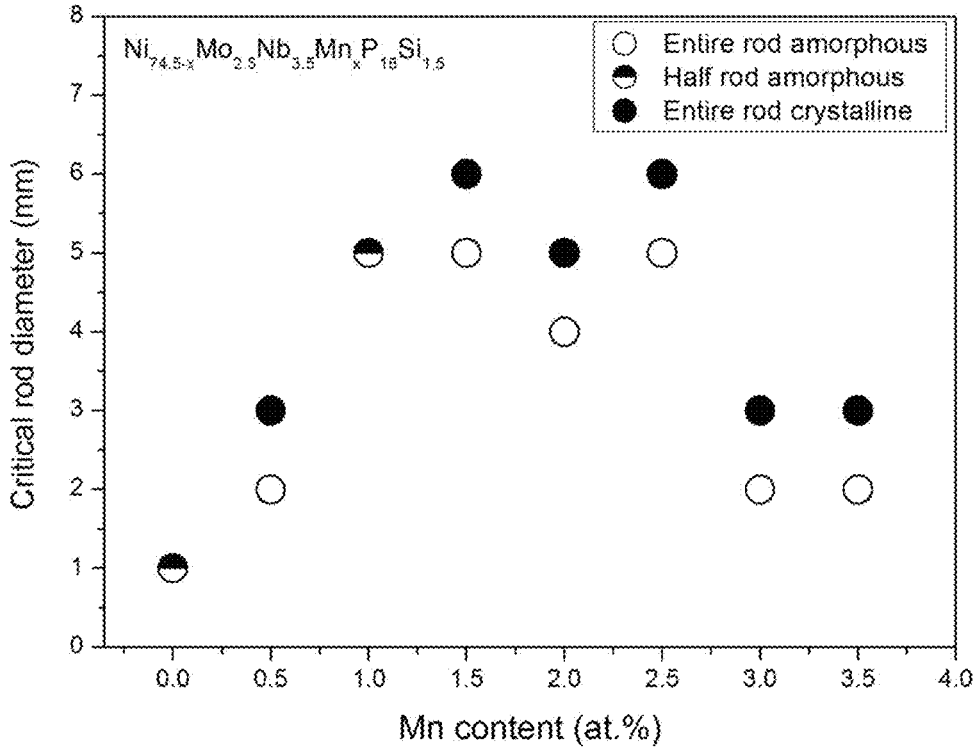
FIG. 12 provides a plot showing the effect of substituting Ni with Mn on the glass-forming ability of $Ni_{74.5-x}Mo_{2.5}Nb_{3.5}Mn_xP_{18}Si_{1.5}$ alloys in accordance with embodiments of the disclosure.
Figure 13:
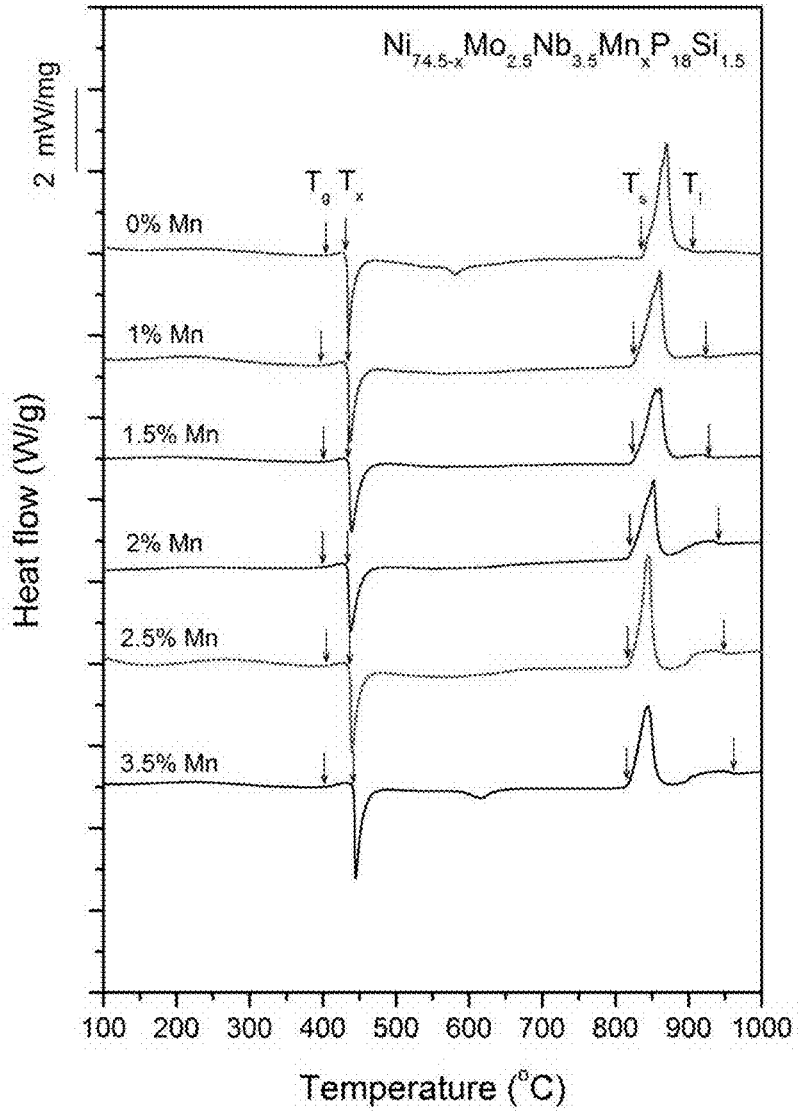
FIG. 13 provides a plot showing calorimetry scans for sample metallic glasses $Ni_{74.5-x}Mo_{2.5}Nb_{3.5}Mn_xP_{18}Si_{1.5}$ in accordance with embodiments of the disclosure. Arrows from left to right designate the glass-transition, crystallization, solidus, and liquidus temperatures, respectively.

Sample metallic glasses, in accordance with embodiments of the disclosure, (Samples 25 and 30-34) showing the effect of substituting Ni with Mn, according to the formula $Ni_{74.5-x}Mo_{2.5}Nb_{3.5}Mn_xP_{18}Si_{1.5}$, are presented in Table 5 and FIG. 12. As shown, when the Mn atomic concentration x is between 0 and 4 percent, the critical rod diameter is at least 1 mm. When the Mn atomic concentration x is at between 0.5 and 3.5 percent, the critical rod diameter is at least 2 mm, and when the Mn atomic concentration x is between 1 and 2.75 percent, the critical rod diameter is at least 4 mm. Differential calorimetry scans for sample metallic glasses in which Ni is substituted with Mn are presented in FIG. 13.

TABLE 5

Sample metallic glasses demonstrating the effect of increasing the Mo atomic concentration at the expense of Nb on the glass-forming ability of Ni—Mo—Nb—Mn—P—Si alloys

| Sample | Composition | Critical Rod Diameter [mm] |
|---|---|---|
| 30 | $Ni_{72.5}Mo_1Nb_5Mn_2P_{18}Si_{1.5}$ | 1 |
| 31 | $Ni_{72.5}Mo_{1.5}Nb_{4.5}Mn_2P_{18}Si_{1.5}$ | 3 |
| 25 | $Ni_{72.5}Mo_2Nb_4Mn_2P_{18}Si_{1.5}$ | 4 |
| 32 | $Ni_{72.5}Mo_{2.5}Nb_{3.5}Mn_2P_{18}Si_{1.5}$ | 4 |
| 33 | $Ni_{72.5}Mo_3Nb_3Mn_2P_{18}Si_{1.5}$ | 3 |
| 34 | $Ni_{72.5}Mo_{3.5}Nb_{2.5}Mn_2P_{18}Si_{1.5}$ | 1 |

Figure 14:
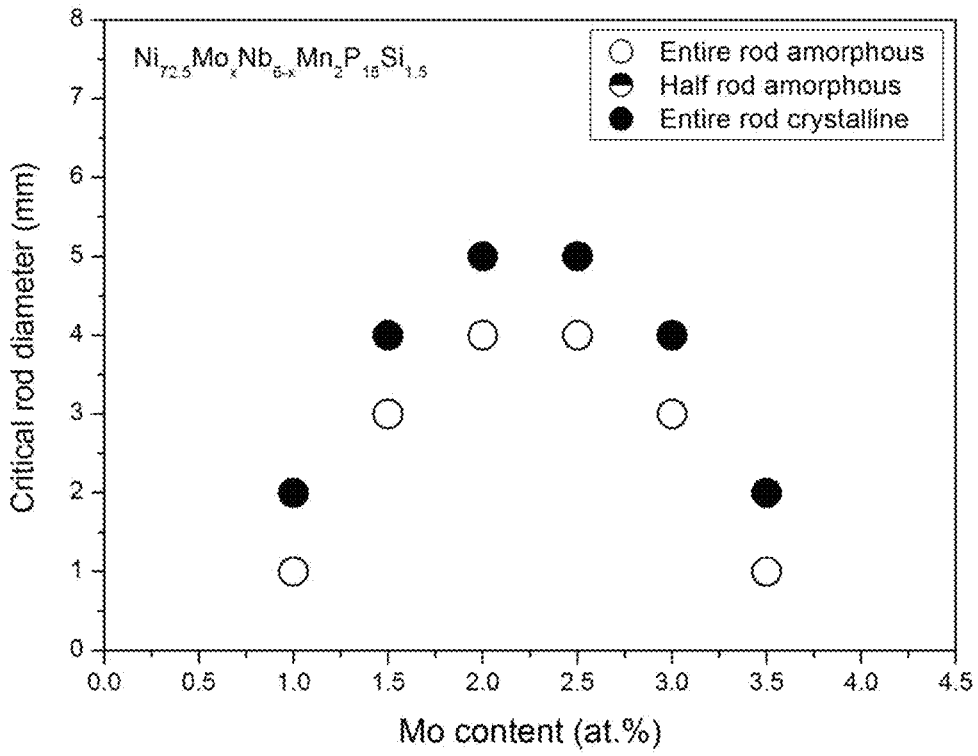
FIG. 14 provides a plot showing the effect of substituting Nb with Mo on the glass-forming ability of $Ni_{72.5-x}Mo_xNb_{6-x}Mn_2P_{18}Si_{1.5}$ alloys in accordance with embodiments of the disclosure.
Figure 15:
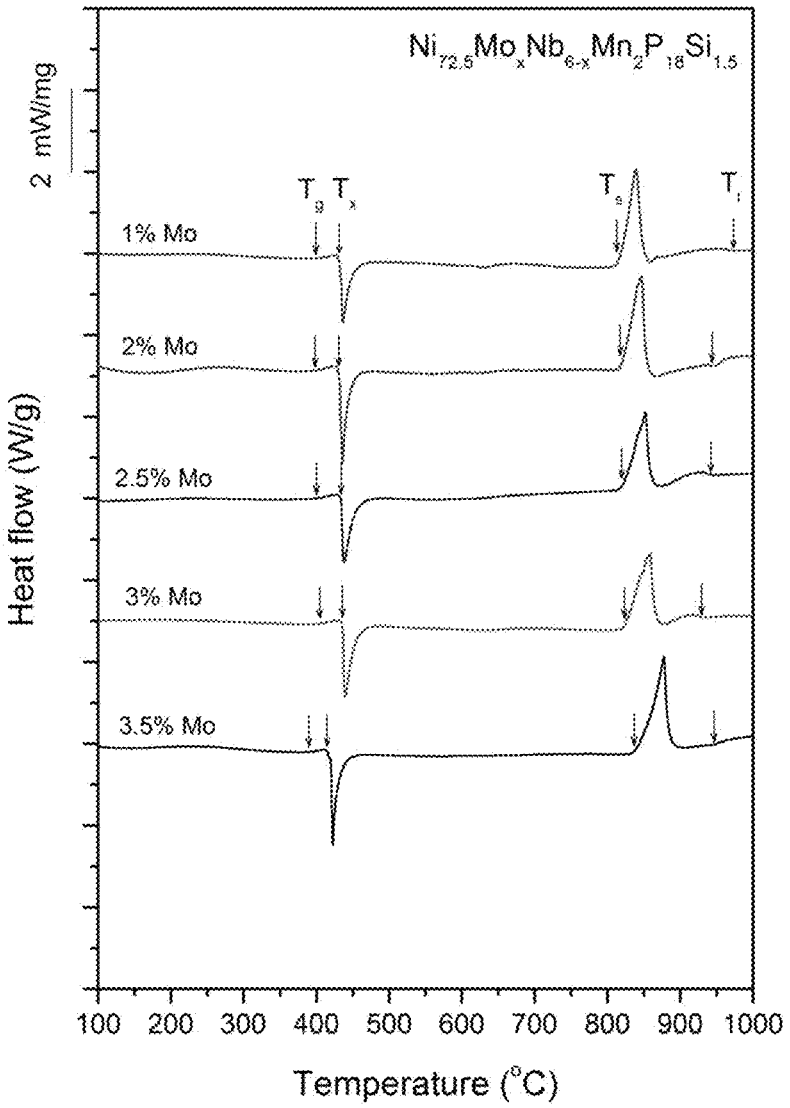
FIG. 15 provides a plot showing calorimetry scans for sample metallic glasses $Ni_{72.5-x}Mo_xNb_{6-x}Mn_2P_{18}Si_{1.5}$ in accordance with embodiments of the disclosure. Arrows from left to right designate the glass-transition, crystallization, solidus, and liquidus temperatures, respectively.

Sample metallic glasses, in accordance embodiments of the disclosure, (Samples 32 and 35-41) showing the effect of substituting Nb with Mo, according to the formula $Ni_{72.5-x}Mo_xNb_{6-x}Mn_2P_{18}Si_{1.5}$, are presented in Table 6 and FIG. 14. As shown, when the Mo atomic concentration x is between 1 and 3.5 percent, the critical rod diameter is at least 1 mm. When the Mo atomic concentration x is at between 1.5 and 3 percent, the critical rod diameter is at least 3 mm, and when the Mn atomic concentration x is between 2 and 2.5 percent, the critical rod diameter is at least 4 mm. Differential calorimetry scans for sample metallic glasses in which Nb is substituted with Mo are presented in FIG. 15.

TABLE 6

Sample metallic glasses demonstrating the effect of increasing the Mn atomic concentration at the expense of Ni on the glass-forming ability of Ni—Mo—Nb—Mn—P—Si alloys

| Sample | Composition | Critical Rod Diameter [mm] |
|---|---|---|
| 35 | $Ni_{74.5}Mo_{2.5}Nb_{3.5}P_{18}Si_{1.5}$ | 1 |
| 36 | $Ni_{74}Mo_{2.5}Nb_{3.5}Mn_{0.5}P_{18}Si_{1.5}$ | 2 |
| 37 | $Ni_{73.5}Mo_{2.5}Nb_{3.5}Mn_1P_{18}Si_{1.5}$ | 5 |

TABLE 6-continued

Sample metallic glasses demonstrating the effect of increasing the Mn atomic concentration at the expense of Ni on the glass-forming ability of Ni—Mo—Nb—Mn—P—Si alloys

| Sample | Composition | Critical Rod Diameter [mm] |
|---|---|---|
| 38 | $Ni_{73}Mo_{2.5}Nb_{3.5}Mn_{1.5}P_{18}Si_{1.5}$ | 5 |
| 32 | $Ni_{72.5}Mo_{2.5}Nb_{3.5}Mn_{2}P_{18}Si_{1.5}$ | 4 |
| 39 | $Ni_{72}Mo_{2.5}Nb_{3.5}Mn_{2.5}P_{18}Si_{1.5}$ | 5 |
| 40 | $Ni_{71.5}Mo_{2.5}Nb_{3.5}Mn_{3}P_{18}Si_{1.5}$ | 2 |
| 41 | $Ni_{71}Mo_{2.5}Nb_{3.5}Mn_{3.5}P_{18}Si_{1.5}$ | 2 |

Figure 16:
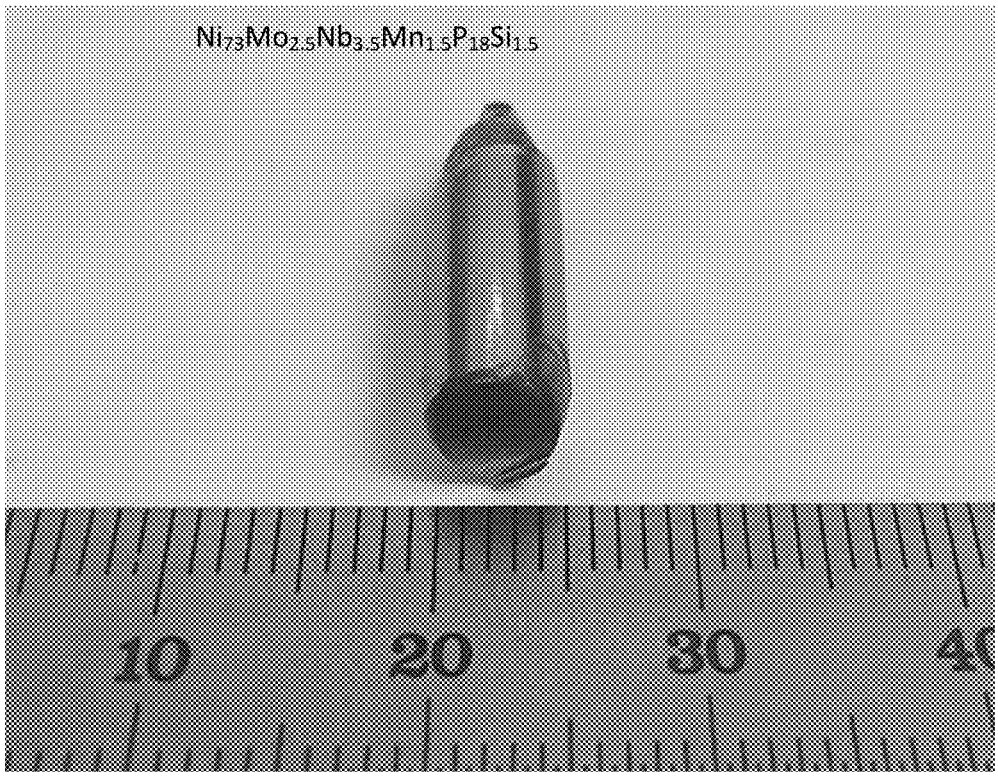
FIG. 16 provides an optical image of a 3 mm metallic glass rod of example alloy $Ni_{73}Mo_{2.5}Nb_{3.5}Mn_{1.5}P_{18}Si_{1.5}$ in accordance with an embodiment of the disclosure.
Figure 17:
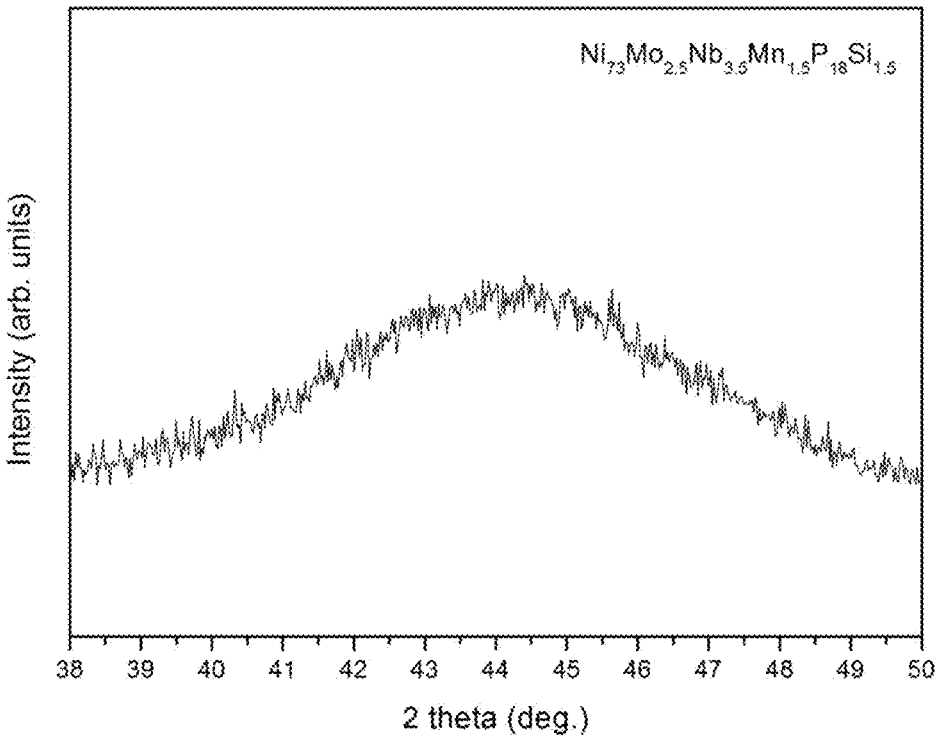
FIG. 17 provides an x-ray diffractogram verifying the amorphous structure of a 3 mm metallic glass rod of example alloy $Ni_{73}Mo_{2.5}Nb_{3.5}Mn_{1.5}P_{18}Si_{1.5}$ in accordance with embodiments of the disclosure.

An image of a 5 mm metallic glass rod of example alloy $Ni_{73}Mo_{2.5}Nb_{3.5}Mn_{1.5}P_{18}Si_{1.5}$ is presented in FIG. 16. An x-ray diffractogram verifying the amorphous structure of a 5 mm metallic glass rod of example alloy $Ni_{73}Mo_{2.5}Nb_{3.5}Mn_{1.5}P_{18}Si_{1.5}$ is shown in FIG. 17.

Example Alloy System 3: Ni—Cr—Mn—P—Si

The alloys according to embodiments of the disclosure may demonstrate high-glass-forming ability. In some embodiments of the disclosure, Ni-based alloys with a Cr content of between 5 and 15 atomic percent, a Mn content of between 1 and 7 atomic percent, a P content of between 16 and 21 atomic percent, and a Si content of between 0.5 and 3 atomic percent have a critical rod diameter of at least 1 mm. In other embodiments, Ni-based alloys with a Cr content of between 8 and 10 atomic percent, a Mn content of between 2 and 5 atomic percent, a P content of between 17 and 19 atomic percent, and a Si content of between 1 and 2 atomic percent a critical rod diameter of at least 4 mm.

The alloys according to embodiments of the disclosure may also demonstrate a high stability of the supercooled liquid against crystallization, ΔT. In some embodiments of the disclosure, Ni-based alloys with a Cr content of between 6 and 15 atomic percent, a Mn content of between 0.25 and 6 atomic percent, a combined P and Si content of between 18 and 21 atomic percent, and a Si content of between 0.5 and 4 atomic percent have a stability of the supercooled liquid against crystallization ΔT of at least 50° C. In other embodiments, Ni-based alloys with a Cr content of between 8 and 11 atomic percent, a Mn content of between 2 and 3.5 atomic percent, a combined P and Si content of between 18.5 and 19.5 atomic percent, and a Si content of between 0.25 and 1.5 atomic percent have a stability of the supercooled liquid against crystallization ΔT of at least 62.5° C.

Figure 18:
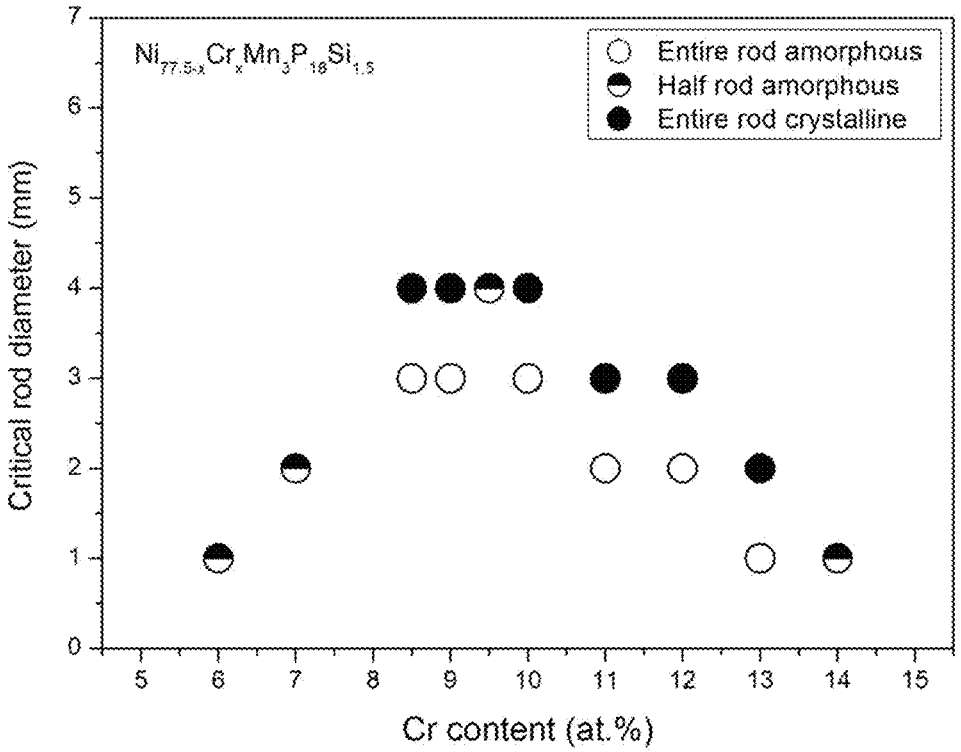
FIG. 18 provides a plot showing the effect of substituting Ni with Cr on the glass-forming ability of $Ni_{77.5-x}Cr_xMn_3P_{18}Si_{1.5}$ alloys in accordance with embodiments of the disclosure.

Sample metallic glasses (Samples 42-51) showing the effect of substituting Ni with Cr, according to the formula $Ni_{77.5-x}Cr_xMn_3P_{18}Si_{1.5}$, are presented in Table 7 and FIG. 18. As shown, when the Cr atomic concentration x is between 5 and 15 percent, the critical rod diameter is at least 1 mm; when the Cr atomic concentration x is between 6 and 13 percent, the critical rod diameter is at least 2 mm; when the Cr atomic concentration x is between 7 and 11 percent, the critical rod diameter is at least 3 mm; and when the Cr atomic concentration x is between 8 and 10 percent, the critical rod diameter is at least 4 mm.

TABLE 7

Sample metallic glasses demonstrating the effect of increasing the Cr atomic concentration at the expense of NI on the glass-forming ability of Ni—Cr—Mn—P—Si alloys

| Sample | Composition | Critical Rod Diameter [mm] |
|---|---|---|
| 42 | $Ni_{71.5}Cr_6Mn_3P_{18}Si_{1.5}$ | 1 |
| 43 | $Ni_{70.5}Cr_7Mn_3P_{18}Si_{1.5}$ | 2 |
| 44 | $Ni_{69}Cr_{8.5}Mn_3P_{18}Si_{1.5}$ | 3 |
| 45 | $Ni_{68.5}Cr_9Mn_3P_{18}Si_{1.5}$ | 3 |
| 46 | $Ni_{68}Cr_{9.5}Mn_3P_{18}Si_{1.5}$ | 4 |
| 47 | $Ni_{67.5}Cr_{10}Mn_3P_{18}Si_{1.5}$ | 3 |
| 48 | $Ni_{66.5}Cr_{11}Mn_3P_{18}Si_{1.5}$ | 2 |
| 49 | $Ni_{65.5}Cr_{12}Mn_3P_{18}Si_{1.5}$ | 2 |
| 50 | $Ni_{64.5}Cr_{13}Mn_3P_{18}Si_{1.5}$ | 1 |
| 51 | $Ni_{63.5}Cr_{14}Mn_3P_{18}Si_{1.5}$ | 1 |

Figure 19:
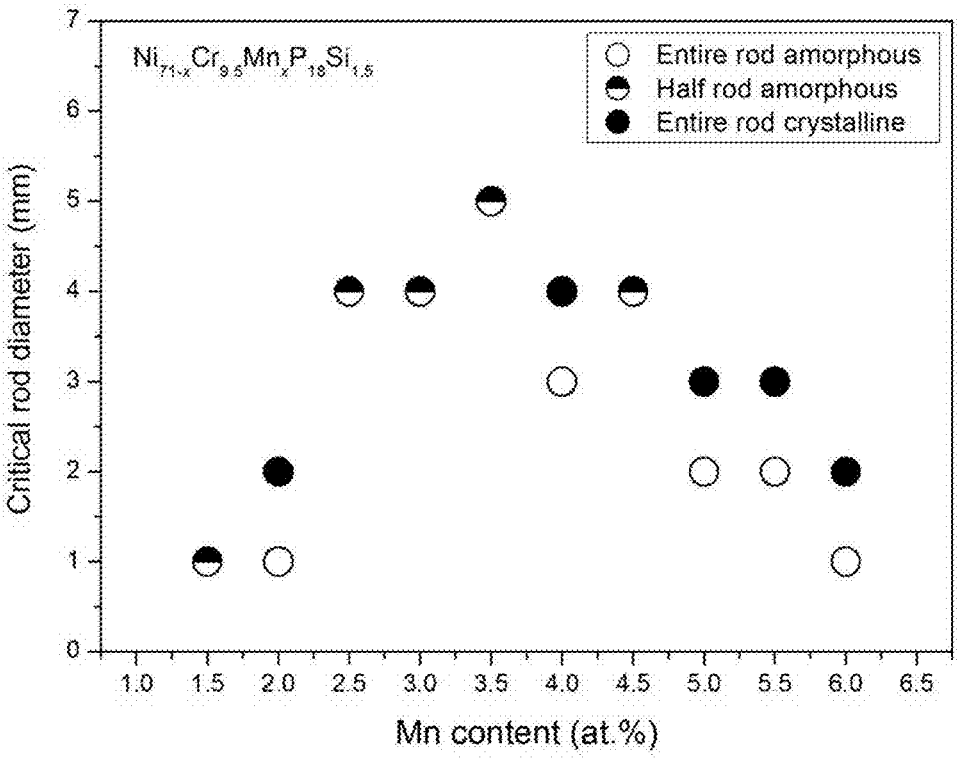
FIG. 19 provides a plot showing the effect of substituting Ni with Mn on the glass-forming ability of $Ni_{71-x}Cr_{9.5}Mn_xP_{18}Si_{1.5}$ alloys in accordance with embodiments of the disclosure.

Sample metallic glasses (Samples 46 and 52-60) showing the effect of substituting Ni with Mn, according to the formula $Ni_{71-x}Cr_{9.5}Mn_xP_{18}Si_{1.5}$, are presented in Table 8 and FIG. 19. As shown, when the Mn atomic concentration x is between 1 and 7 percent, the critical rod diameter is at least 1 mm; when the Mn atomic concentration x is between 2 and 6 percent, the critical rod diameter is at least 2 mm; when the Mn atomic concentration x is between 2 and 5.5 percent, the critical rod diameter is at least 3 mm; and when the Mn atomic concentration x is between 2 and 5 percent, the critical rod diameter is at least 4 mm.

TABLE 8

Sample metallic glasses demonstrating the effect of increasing the Mn atomic concentration at the expense of NI on the glass-forming ability of Ni—Cr—Mn—P—Si alloys

| Sample | Composition | Critical Rod Diameter [mm] |
|---|---|---|
| 52 | $Ni_{69.5}Cr_{9.5}Mn_{1.5}P_{18}Si_{1.5}$ | 1 |
| 53 | $Ni_{69}Cr_{9.5}Mn_{2}P_{18}Si_{1.5}$ | 1 |
| 54 | $Ni_{68.5}Cr_{9.5}Mn_{2.5}P_{18}Si_{1.5}$ | 4 |
| 46 | $Ni_{68}Cr_{9.5}Mn_{3}P_{18}Si_{1.5}$ | 4 |
| 55 | $Ni_{67.5}Cr_{9.5}Mn_{3.5}P_{18}Si_{1.5}$ | 5 |
| 56 | $Ni_{67}Cr_{9.5}Mn_{4}P_{18}Si_{1.5}$ | 3 |
| 57 | $Ni_{66.5}Cr_{9.5}Mn_{4.5}P_{18}Si_{1.5}$ | 4 |
| 58 | $Ni_{66}Cr_{9.5}Mn_{5}P_{18}Si_{1.5}$ | 2 |
| 59 | $Ni_{65.5}Cr_{9.5}Mn_{5.5}P_{18}Si_{1.5}$ | 2 |
| 60 | $Ni_{65}Cr_{9.5}Mn_{6}P_{18}Si_{1.5}$ | 1 |

Figure 20:
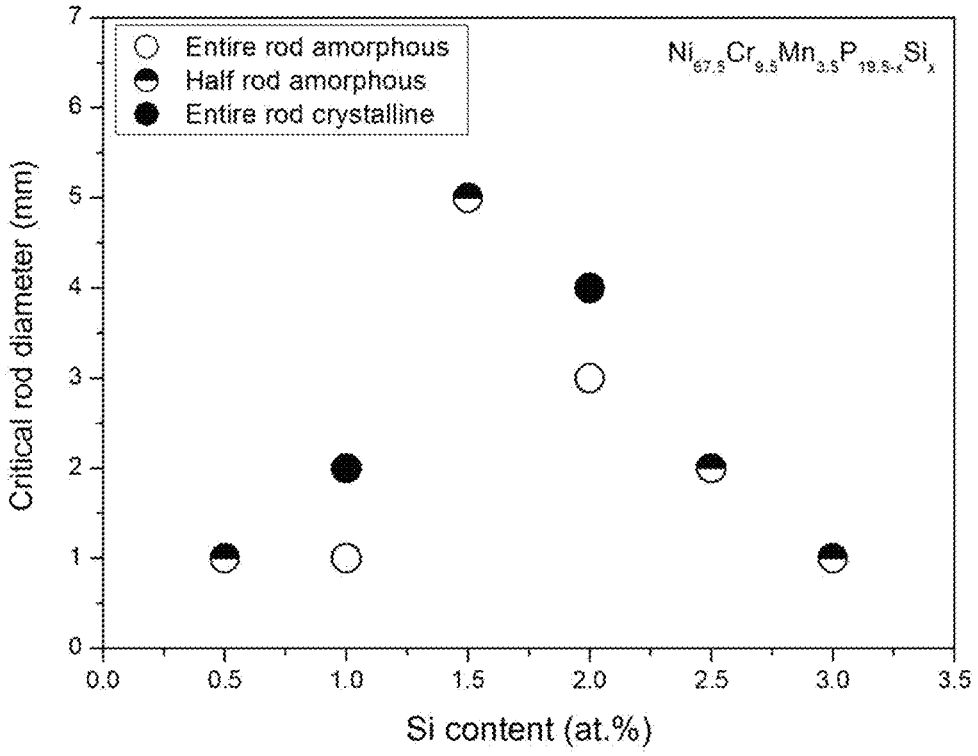
FIG. 20 provides a plot showing the effect of substituting P with Si on the glass-forming ability of $Ni_{67.5}Cr_{9.5}Mn_{3.5}P_{19.5-x}Si_x$ alloys in accordance with embodiments of the disclosure.

Sample metallic glasses (Samples 55 and 61-65) showing the effect of substituting P with Si, according to the formula $Ni_{67.5}Cr_{9.5}Mn_{3.5}P_{19.5-x}Si_x$, are presented in Table 9 and FIG. 20. As shown, when the Si atomic concentration x is between 0.25 and 3 percent, the critical rod diameter is at least 1 mm; when the Si atomic concentration x is between 1 and 2.5 percent, the critical rod diameter is at least 2 mm; when the Si atomic concentration x is between 1 and 2.25 percent, the critical rod diameter is at least 3 mm; and when the Si atomic concentration x is between 1 and 2 percent, the critical rod diameter is at least 4 mm.

TABLE 9

Sample metallic glasses demonstrating the effect of increasing the Si atomic concentration at the expense of P on the glass-forming ability of Ni—Cr—Mn—P—Si alloys

| Sample | Composition | Critical Rod Diameter [mm] |
|---|---|---|
| 61 | $Ni_{67.5}Cr_{9.5}Mn_{3.5}P_{19}Si_{0.5}$ | 1 |
| 62 | $Ni_{67.5}Cr_{9.5}Mn_{3.5}P_{18.5}Si_{1}$ | 1 |
| 55 | $Ni_{67.5}Cr_{9.5}Mn_{3.5}P_{18}Si_{1.5}$ | 5 |
| 63 | $Ni_{67.5}Cr_{9.5}Mn_{3.5}P_{17.5}Si_{2}$ | 3 |
| 64 | $Ni_{67.5}Cr_{9.5}Mn_{3.5}P_{17}Si_{2.5}$ | 2 |
| 65 | $Ni_{67.5}Cr_{9.5}Mn_{3.5}P_{16.5}Si_{3}$ | 1 |

Figure 21:
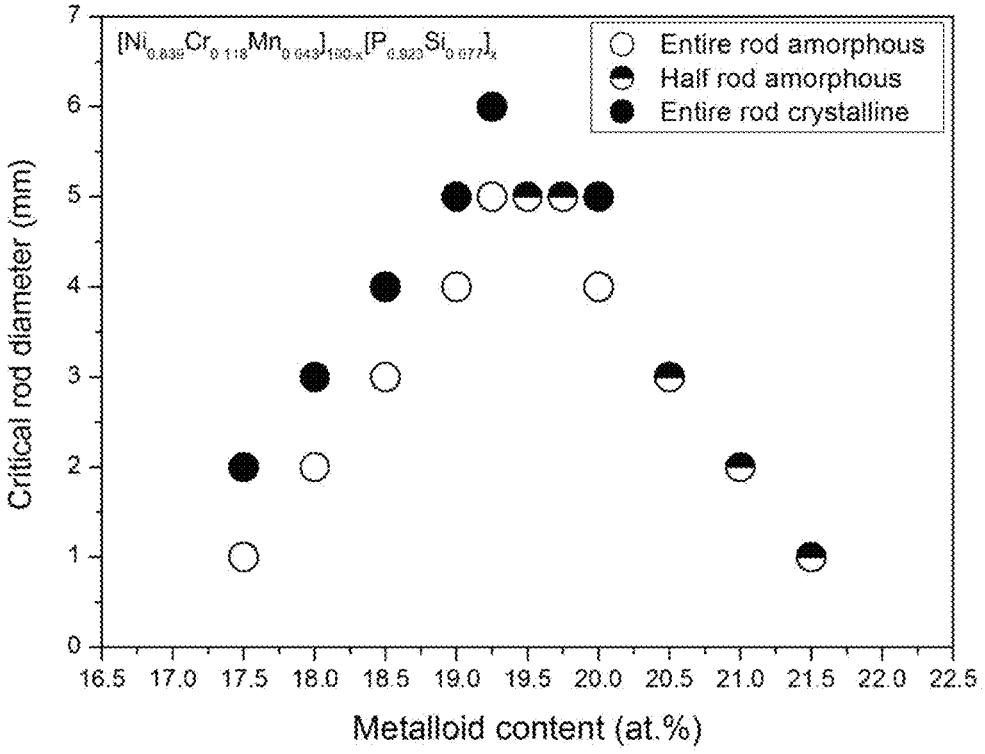
FIG. 21 provides a plot showing the effect of varying the ratio of metals to metalloids on the glass-forming ability of $(Ni_{0.839}Cr_{0.118}Mn_{0.043})_{100-x}(P_{0.923}Si_{0.077})_x$ alloys in accordance with embodiments of the disclosure.

Sample metallic glasses (Samples 55 and 66-75) showing the effect of increasing the total metalloid concentration at the expense of metals, according to the formula $(Ni_{0.839}Cr_{0.118}Mn_{0.043})_{100-x}(P_{0.923}Si_{0.077})_x$, are presented in Table 10 and FIG. 21. As shown, when the metalloids atomic concentration x is between 17 and 22 percent, the critical rod diameter is at least 1 mm; when the metalloids atomic concentration x is between 17.25 and 21.25 percent, the critical rod diameter is at least 2 mm; when the metalloids atomic concentration x is between 18.25 and 20.75 percent, the critical rod diameter is at least 3 mm; when the metalloids atomic concentration x is between 18.75 and 20.25 percent, the critical rod diameter is at least 4 mm; and when the metalloids atomic concentration x is between 19 and 20 percent, the critical rod diameter is at least 5 mm.

TABLE 10

Sample amorphous alloys demonstrating the effect of increasing the total metalloid concentration at the expense of metals on the glass-forming ability of the Ni—Cr—Mn—P—Si system

| Sample | Composition | Critical Rod Diameter [mm] |
|---|---|---|
| 66 | $Ni_{69.18}Cr_{9.74}Mn_{3.58}P_{16.15}Si_{1.35}$ | 1 |
| 67 | $Ni_{68.76}Cr_{9.68}Mn_{3.56}P_{16.62}Si_{1.38}$ | 2 |
| 68 | $Ni_{68.34}Cr_{9.62}Mn_{3.54}P_{17.08}Si_{1.42}$ | 3 |
| 69 | $Ni_{67.92}Cr_{9.56}Mn_{3.52}P_{17.54}Si_{1.46}$ | 4 |
| 70 | $Ni_{67.71}Cr_{9.53}Mn_{3.51}P_{17.77}Si_{1.48}$ | 5 |
| 55 | $Ni_{67.5}Cr_{9.5}Mn_{3.5}P_{18}Si_{1.5}$ | 5 |
| 71 | $Ni_{67.29}Cr_{9.47}Mn_{3.49}P_{18.23}Si_{1.52}$ | 5 |
| 72 | $Ni_{67.08}Cr_{9.44}Mn_{3.48}P_{18.46}Si_{1.54}$ | 4 |
| 73 | $Ni_{66.66}Cr_{9.38}Mn_{3.46}P_{18.92}Si_{1.58}$ | 3 |
| 74 | $Ni_{66.24}Cr_{9.32}Mn_{3.44}P_{19.38}Si_{1.62}$ | 2 |
| 75 | $Ni_{65.82}Cr_{9.26}Mn_{3.42}P_{19.85}Si_{1.65}$ | 1 |

Figure 22:
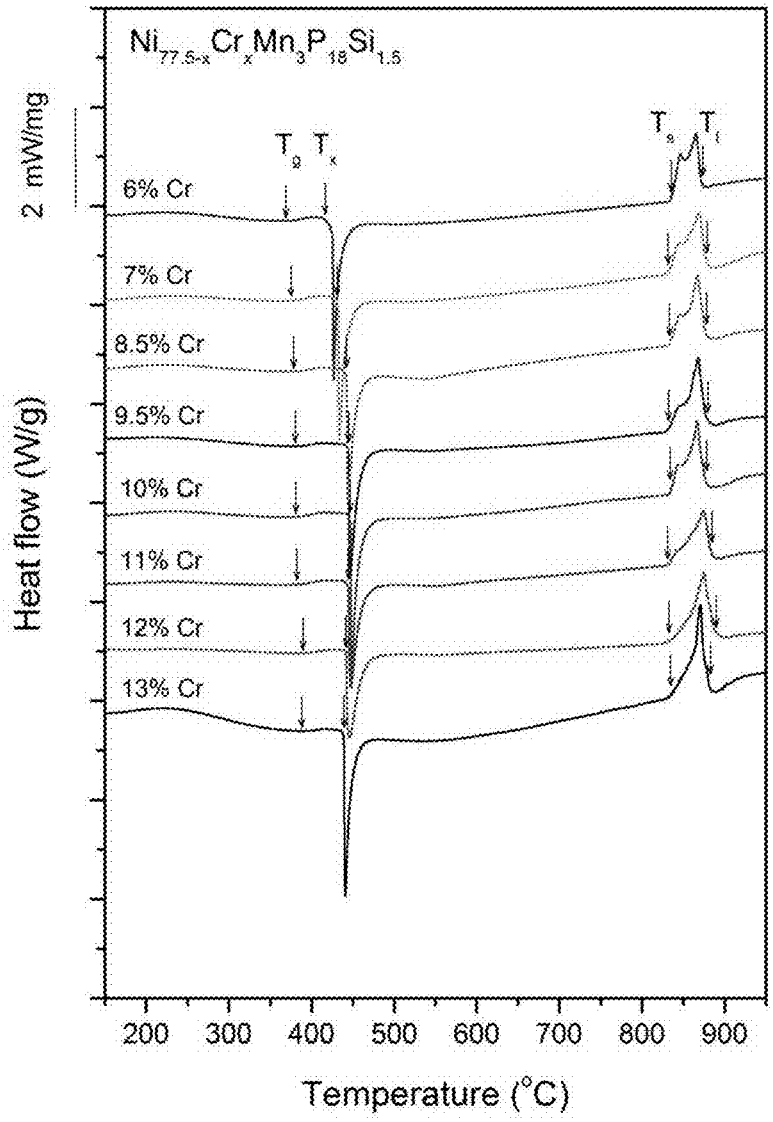
FIG. 22 provides a plot showing calorimetry scans for sample metallic glasses $Ni_{77.5-x}Cr_xMn_3P_{18}Si_{1.5}$ in accordance with embodiments of the disclosure. Arrows from left to right designate the glass-transition temperature $T_g$, crystallization temperature $T_x$, solidus temperature $T_s$, and liquidus temperature $T_l$.
Figure 23:
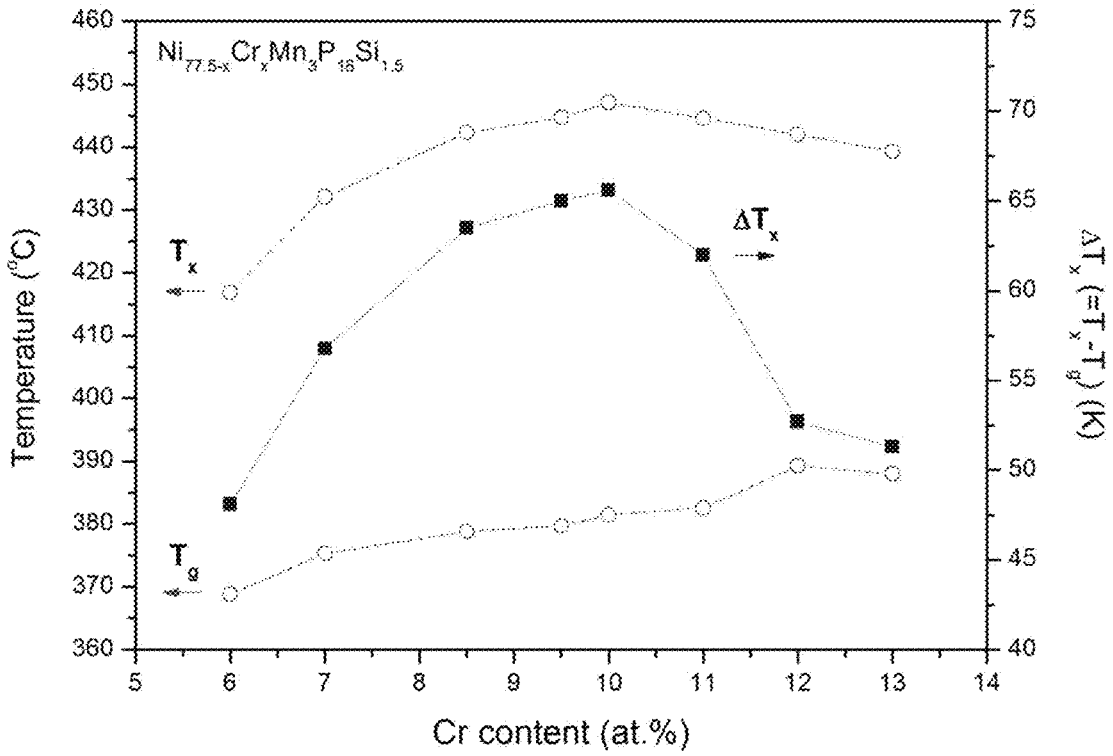
FIG. 23 provides a plot showing the effect of substituting Ni with Cr on the glass-transition temperature $T_g$, crystallization temperature $T_x$, and the difference between the glass-transition temperature and the crystallization temperature, $\Delta T=T_x-T_g$, for $Ni_{77.5-x}Cr_xMn_3P_{18}Si_1$ metallic glasses in accordance with embodiments of the disclosure.

Differential calorimetry scans for sample metallic glasses in which Ni is substituted with Cr according to the formula $Ni_{77.5-x}Cr_xMn_3P_{18}Si_{1.5}$ are presented in FIG. 22. The glass-transition temperature $T_g$, crystallization temperature $T_x$, difference between glass-transition and crystallization temperatures $\Delta T=T_x-T_g$, solidus temperature $T_s$, and liquidus temperature $T_l$ for sample alloys metallic glasses according to the formula $Ni_{77.5-x}Cr_xMn_3P_{18}Si_{1.5}$ are listed in Table 11. The glass-transition temperature $T_g$, crystallization temperature $T_x$, and difference between glass-transition and crystallization temperatures $\Delta T=T_x-T_g$ for sample metallic glasses according to the formula $Ni_{77.5-x}Cr_xMn_3P_{18}Si_{1.5}$ are plotted in FIG. 23. As shown, when the Cr atomic concentration x is between 6 and 15 percent, ΔT is at least 50° C.; when the Cr atomic concentration x is between 7 and 12 percent, ΔT is at least 55° C.; when the Cr atomic concentration x is between 7.5 and 11.5 percent, ΔT is at least 60° C.; and when the Cr atomic concentration x is between 8 and 11 percent, ΔT is at least 62.5° C.

TABLE 11

Effect of increasing the Cr atomic concentration at the expense of Ni on the glass-transition, crystallization, $\Delta T_x$ ($=T_x - T_g$), solidus, and liquidus temperatures of Ni—Cr—Mn—P—Si alloys

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 42 | $Ni_{71.5}Cr_6Mn_3P_{18}Si_{1.5}$ | 368.8 | 416.9 | 48.1 | 835.7 | 871.7 |
| 43 | $Ni_{70.5}Cr_7Mn_3P_{18}Si_{1.5}$ | 375.3 | 432.1 | 56.8 | 832.6 | 877.7 |
| 44 | $Ni_{69}Cr_{8.5}Mn_3P_{18}Si_{1.5}$ | 378.8 | 442.3 | 63.5 | 833.2 | 877.4 |
| 46 | $Ni_{68}Cr_{9.5}Mn_3P_{18}Si_{1.5}$ | 379.7 | 444.7 | 65.0 | 831.5 | 878.0 |
| 47 | $Ni_{67.5}Cr_{10}Mn_3P_{18}Si_{1.5}$ | 381.5 | 447.1 | 65.6 | 834.3 | 877.8 |
| 48 | $Ni_{66.5}Cr_{11}Mn_3P_{18}Si_{1.5}$ | 382.6 | 444.6 | 62.0 | 832.4 | 883.6 |
| 49 | $Ni_{65.5}Cr_{12}Mn_3P_{18}Si_{1.5}$ | 389.3 | 442.0 | 52.7 | 831.8 | 888.8 |
| 50 | $Ni_{64.5}Cr_{13}Mn_3P_{18}Si_{1.5}$ | 388.0 | 439.3 | 51.3 | 833.0 | 882.0 |

Figure 24:
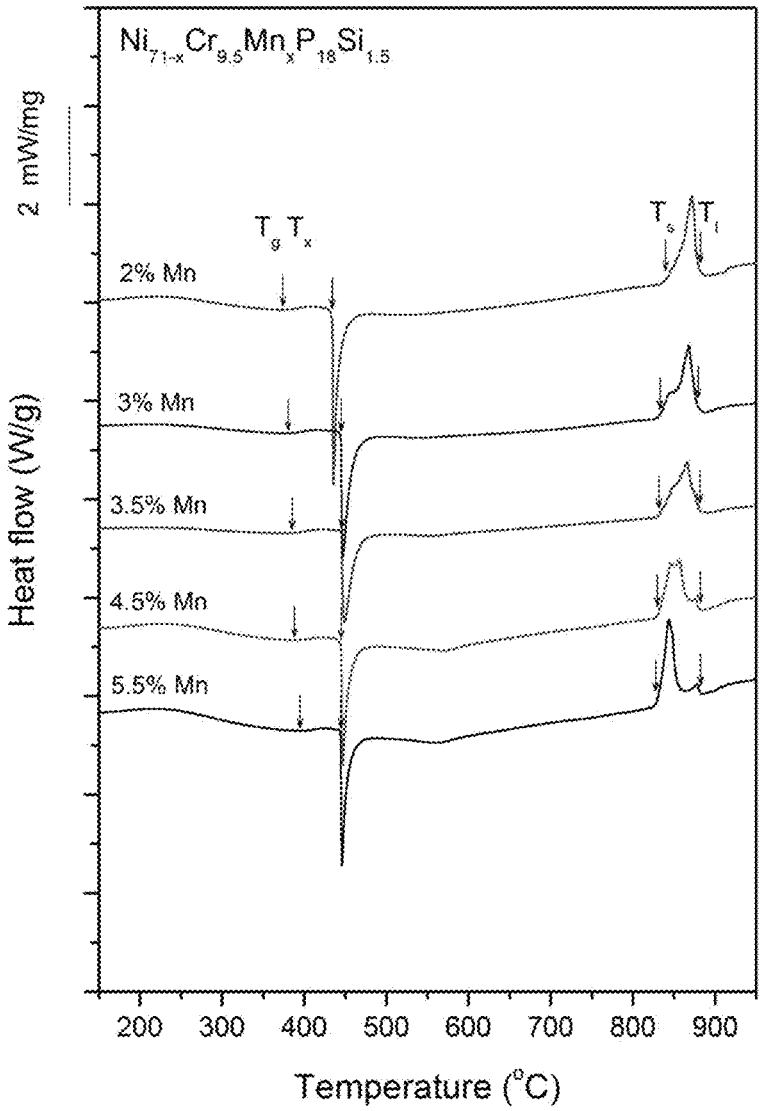
FIG. 24 provides a plot showing calorimetry scans for sample metallic glasses $Ni_{71-x}Cr_{9.5}Mn_xP_{18}Si_{1.5}$ in accordance with embodiments of the disclosure. Arrows from left to right designate the glass-transition temperature $T_g$, crystallization temperature $T_x$, solidus temperature $T_s$, and liquidus temperature $T_l$.
Figure 25:
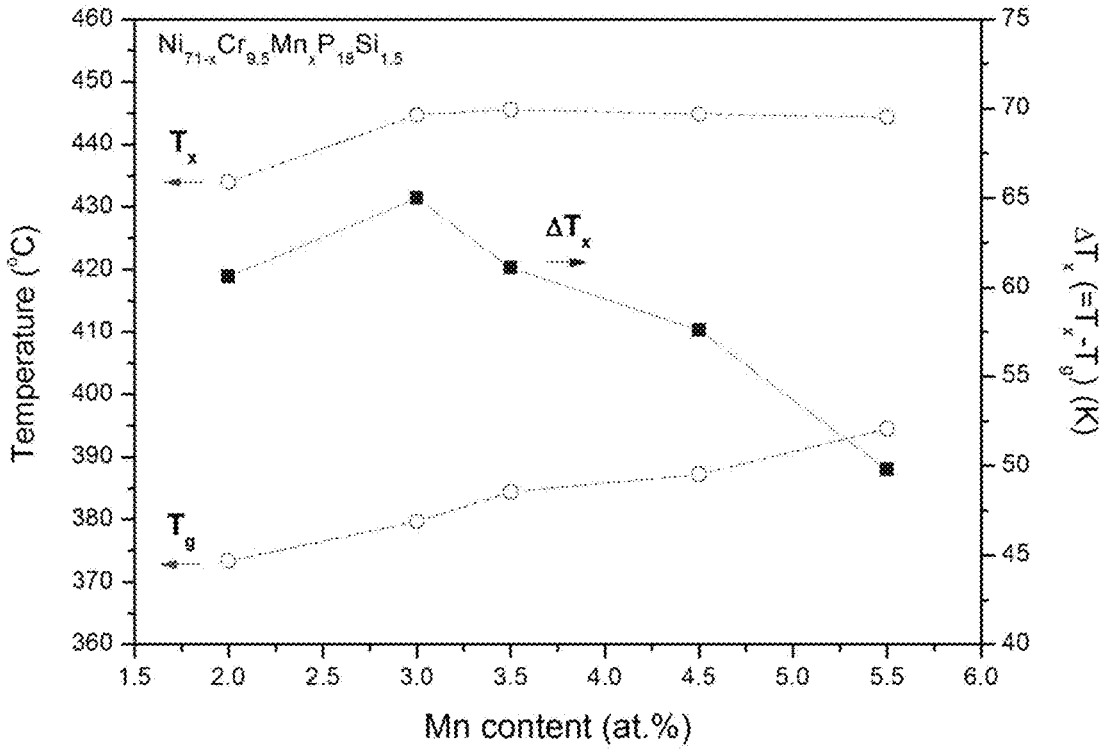
FIG. 25 provides a plot showing the effect of substituting Ni with Mn on the glass-transition temperature $T_g$, crystallization temperature $T_x$, and the difference between the glass-transition temperature and the crystallization temperature, $\Delta T=T_x-T_g$, for $Ni_{71-x}Cr_{9.5}Mn_xP_{18}Si_{1.5}$ metallic glasses in accordance with embodiments of the disclosure.

Differential calorimetry scans for sample metallic glasses in which Ni is substituted with Mn according to the formula $Ni_{71-x}Cr_{9.5}Mn_xP_{18}Si_{1.5}$ are presented in FIG. 24. The glass-transition temperature $T_g$, crystallization temperature $T_x$, difference between glass-transition and crystallization temperatures $\Delta T=T_x-T_g$, solidus temperature $T_s$, and liquidus temperature $T_l$ for sample alloys metallic glasses according to the formula $Ni_{71-x}Cr_{9.5}Mn_xP_{18}Si_{1.5}$ are listed in Table 12. The glass-transition temperature $T_g$, crystallization temperature $T_x$, and difference between glass-transition and crystallization temperatures $\Delta T=T_x-T_g$ for sample metallic glasses according to the formula $Ni_{71-x}Cr_{9.5}Mn_xP_{18}Si_{1.5}$ are plotted in FIG. 25. As shown, when the Mn atomic concentration x is between 1 and 6 percent, ΔT is at least 50° C.; when the Mn atomic concentration x is between 2 and 5 percent, ΔT is at least 55° C.; when the Mn atomic concentration x is between 2 and 4 percent, ΔT is at least 60° C.; and when the Mn atomic concentration x is between 2 and 3.5 percent, ΔT is at least 62.5° C.

TABLE 12

Effect of increasing the Mn atomic concentration at the expense of Ni on the glass-transition, crystallization, $\Delta T_x$ (=$T_x$ − $T_g$), solidus, and liquidus temperatures of Ni—Cr—Mn—P—Si alloys

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 53 | $Ni_{69}Cr_{9.5}Mn_2P_{18}Si_{1.5}$ | 373.4 | 434.0 | 60.6 | 840.1 | 878.4 |
| 46 | $Ni_{68}Cr_{9.5}Mn_3P_{18}Si_{1.5}$ | 379.7 | 444.7 | 65.0 | 831.5 | 878.0 |
| 55 | $Ni_{67.5}Cr_{9.5}Mn_{3.5}P_{18}Si_{1.5}$ | 384.4 | 445.5 | 61.1 | 830.3 | 881.2 |
| 57 | $Ni_{66.5}Cr_{9.5}Mn_{4.5}P_{18}Si_{1.5}$ | 387.2 | 444.8 | 57.6 | 829.8 | 879.5 |
| 59 | $Ni_{65.5}Cr_{9.5}Mn_{5.5}P_{18}Si_{1.5}$ | 394.5 | 444.3 | 49.8 | 828.8 | 881.8 |

Figure 26:
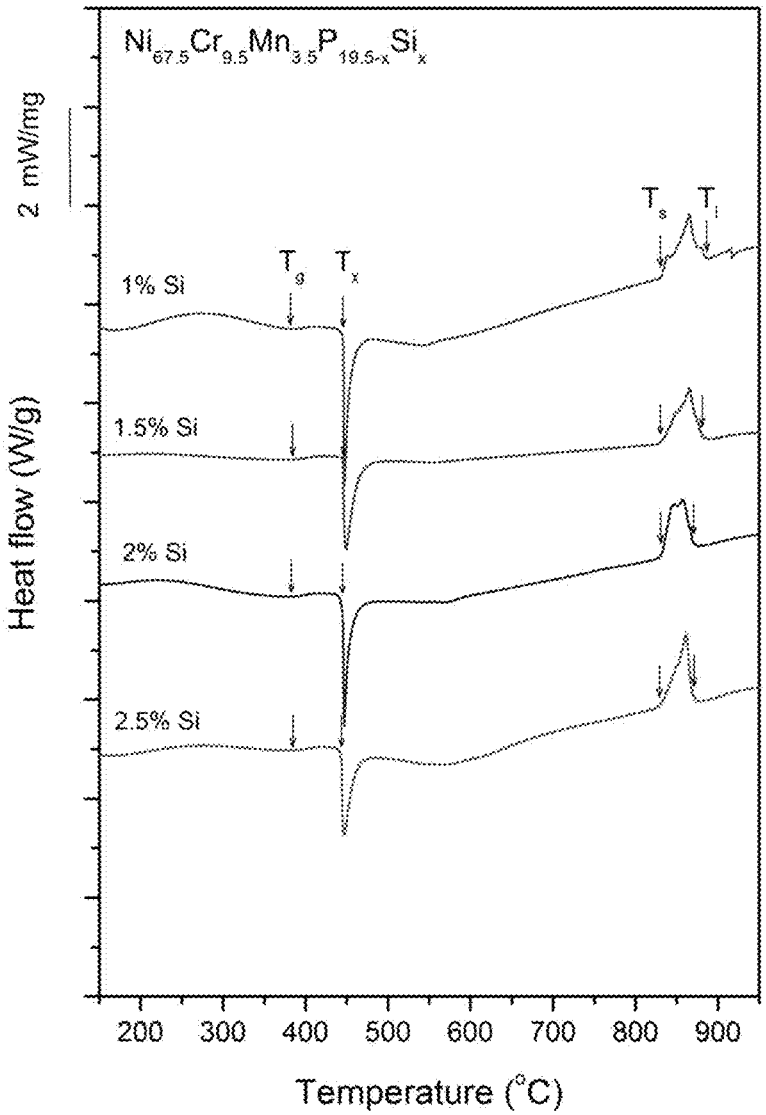
FIG. 26 provides a plot showing calorimetry scans for sample metallic glasses $Ni_{67.5}Cr_{9.5}Mn_{3.5}P_{19.5-x}Si_x$ in accordance with embodiments of the disclosure. Arrows from left to right designate the glass-transition temperature $T_g$, crystallization temperature $T_x$, solidus temperature $T_s$, and liquidus temperature $T_l$.
Figure 27:
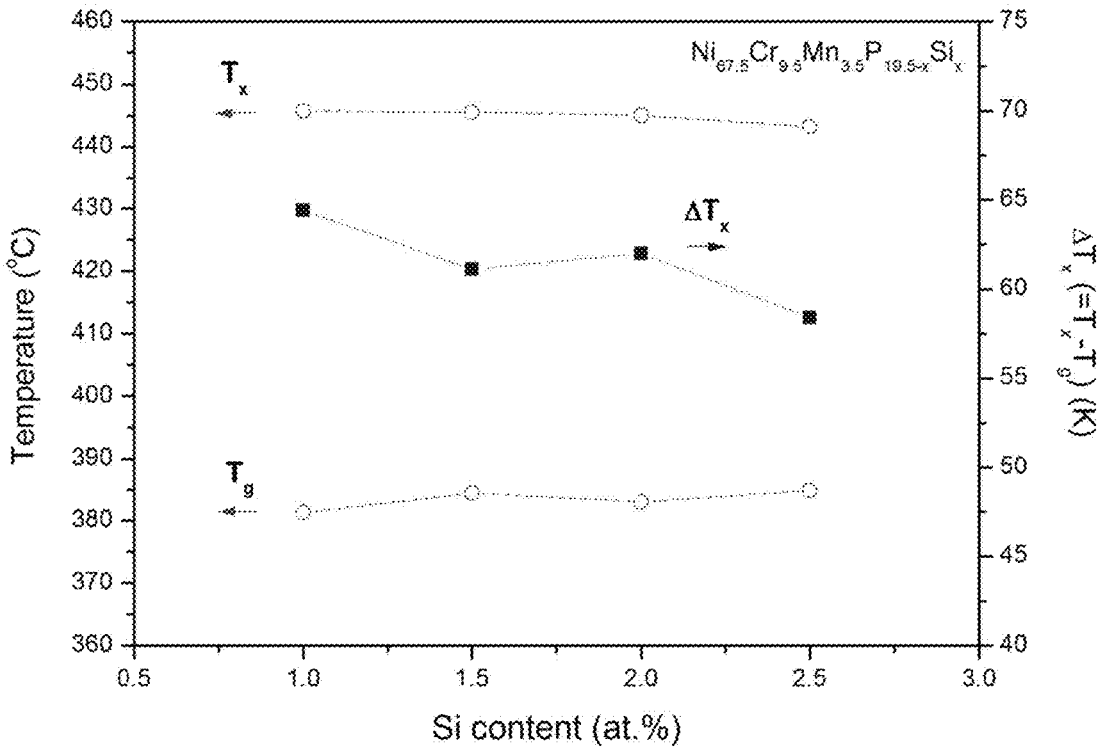
FIG. 27 provides a plot showing the effect of substituting P with Si on the glass-transition temperature $T_g$, crystallization temperature $T_x$, and the difference between the glass-transition temperature and the crystallization temperature, $\Delta T=T_x-T_g$, for $Ni_{67.5}Cr_{9.5}Mn_{3.5}P_{19.5-x}Si_x$ metallic glasses in accordance with embodiments of the disclosure.

Differential calorimetry scans for sample metallic glasses in which P is substituted with Si according to the formula $Ni_{67.5}Cr_{9.5}Mn_{3.5}P_{19.5-x}Si_x$ are presented in FIG. 26. The glass-transition temperature $T_g$, crystallization temperature $T_x$, difference between glass-transition and crystallization temperatures $\Delta T=T_x-T_g$, solidus temperature $T_s$, and liquidus temperature $T_l$ for sample alloys metallic glasses according to the formula $Ni_{67.5}Cr_{9.5}Mn_{3.5}P_{19.4-x}Si_x$ are listed in Table 13. The glass-transition temperature $T_g$, crystallization temperature $T_x$, and difference between glass-transition and crystallization temperatures $\Delta T=T_x-T_g$ for sample metallic glasses according to the formula $Ni_{67.5}Cr_{9.5}Mn_{3.5}P_{19.5-x}Si_x$ are plotted in FIG. 27. As shown, when the Si atomic concentration x is between 0.25 and 3 percent, ΔT is at least 55° C.; when the Si atomic concentration x is between 1 and 2.5 percent, ΔT is at least 57.5° C.; when the Si atomic concentration x is between 1 and 2 percent, ΔT is at least 60° C.; and when the Si atomic concentration x is between 1 and 1.5 percent, ΔT is at least 62.5° C.

TABLE 13

Effect of increasing the Si atomic concentration at the expense of P on the glass-transition, crystallization, $\Delta T_x$ (=$T_x$ − $T_g$), solidus, and liquidus temperatures of Ni—Cr—Mn—P—Si alloys

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 62 | $Ni_{67.5}Cr_{9.5}Mn_{3.5}P_{18.5}Si_1$ | 381.3 | 445.7 | 64.4 | 831.2 | 884.9 |
| 55 | $Ni_{67.5}Cr_{9.5}Mn_{3.5}P_{18}Si_{1.5}$ | 384.4 | 445.5 | 61.1 | 830.3 | 881.2 |
| 63 | $Ni_{67.5}Cr_{9.5}Mn_{3.5}P_{17.5}Si_2$ | 383.0 | 445.0 | 62.0 | 831.6 | 870.7 |
| 64 | $Ni_{67.5}Cr_{9.5}Mn_{3.5}P_{17}Si_{2.5}$ | 384.8 | 443.2 | 58.4 | 830.3 | 868.0 |

Figure 28:
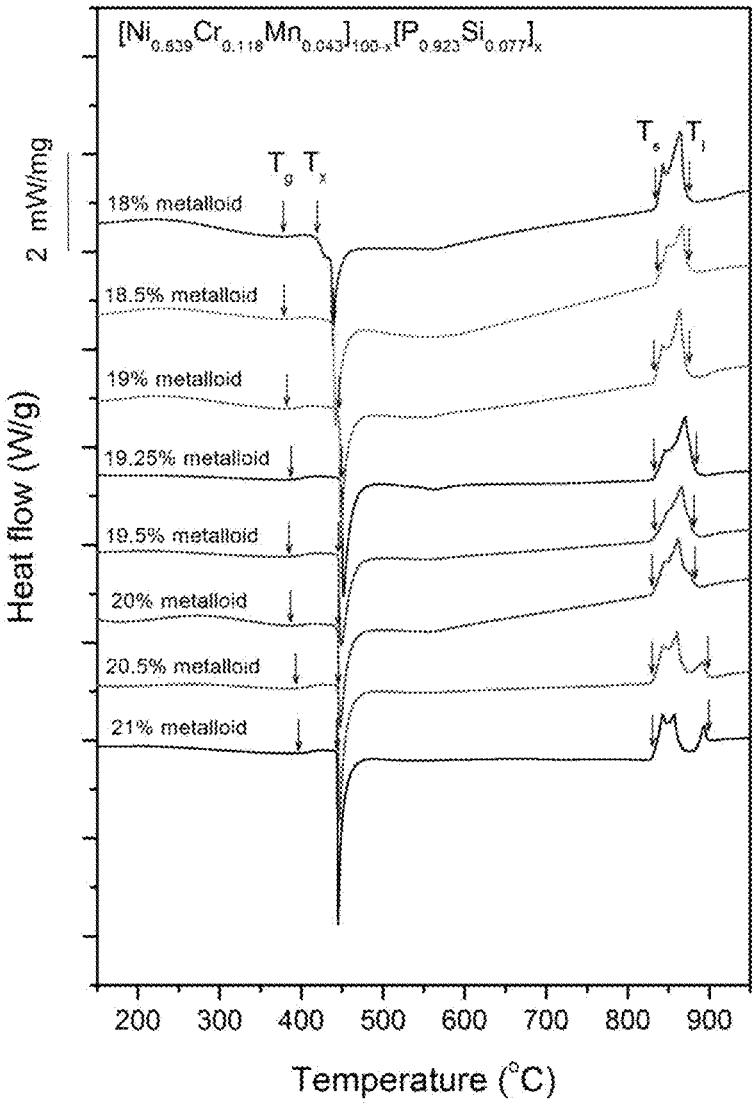
FIG. 28 provides a plot showing calorimetry scans for sample metallic glasses $Ni_{0.839}Cr_{0.118}Mn_{0.043})_{100-x}(P_{0.923}Si_{0.077})_x$ in accordance with embodiments of the disclosure. Arrows from left to right designate the glass-transition temperature $T_g$, crystallization temperature $T_x$, solidus temperature $T_s$, and liquidus temperature $T_l$.
Figure 29:
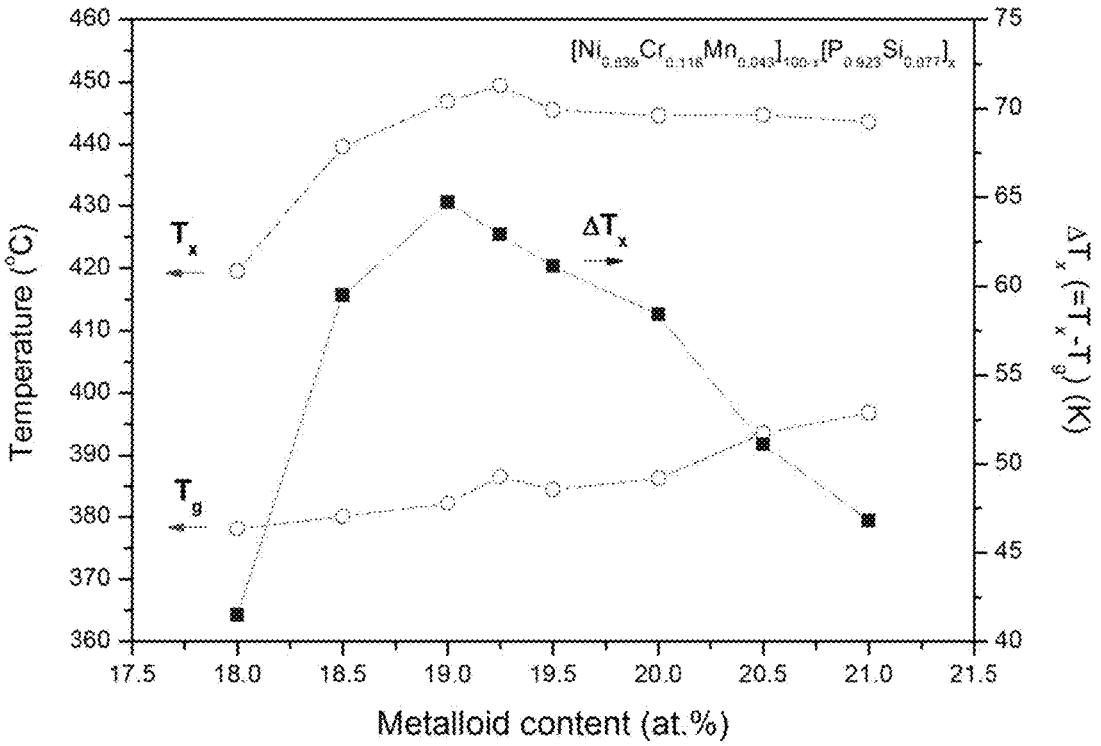
FIG. 29 provides a plot showing the effect of varying the total concentration of metals and metalloids on the glass-transition temperature $T_g$, crystallization temperature $T_x$, and the difference between the glass-transition temperature and the crystallization temperature, $\Delta T=T_x-T_g$, for $Ni_{0.839}Cr_{0.118}Mn_{0.043})_{100-x}(P_{0.923}Si_{0.077})_x$ metallic glasses in accordance with embodiments of the disclosure.

Differential calorimetry scans for sample metallic glasses in which the total metalloid concentration is increased at the expense of metals according to the formula $(Ni_{0.839}Cr_{0.118}Mn_{0.043})_{100-x}(P_{0.923}Si_{0.077})_x$ are presented in FIG. 28. The glass-transition temperature $T_g$, crystallization temperature $T_x$, difference between glass-transition and crystallization temperatures $\Delta T=T_x-T_g$, solidus temperature $T_s$, and liquidus temperature $T_l$ for sample alloys metallic glasses according to the formula $Ni_{0.839}Cr_{0.118}Mn_{0.043})_{100-x}(P_{0.923}Si_{0.077})_x$ are listed in Table 14. The glass-transition temperature $T_g$, crystallization temperature $T_x$, and difference between glass-transition and crystallization temperatures $\Delta T=T_x-T_g$ for sample metallic glasses according to the formula $Ni_{0.839}Cr_{0.118}Mn_{0.043})_{100-x}(P_{0.923}Si_{0.077})_x$ are plotted in FIG. 29. As shown, when the metalloids atomic concentration x is greater than 18 percent and up to 21 percent, ΔT is at least 50° C.; when the metalloids atomic concentration x is greater than 18 percent and up to 20.5 percent, ΔT is at least 52.5° C.; when the metalloids atomic concentration x is between 18.25 and 20.25 percent, ΔT is at least 57.5° C.; when the metalloids atomic concentration x is between 18.5 and 20 percent, ΔT is at least 60° C.; and when the metalloids atomic concentration x is between 18.5 and 19.5 percent, ΔT is at least 62.5° C.

TABLE 14

Effect of increasing the total metalloid concentration at the expense of metals on the glass-transition, crystallization, $\Delta T_x$ (=$T_x$ − $T_g$), solidus, and liquidus temperatures of Ni—Cr—Mn—P—Si alloys

| Sample | Composition | $T_g$ (° C.) | $T_x$ (° C.) | $\Delta T_x$ (° C.) | $T_s$ (° C.) | $T_l$ (° C.) |
|---|---|---|---|---|---|---|
| 67 | $Ni_{68.76}Cr_{9.68}Mn_{3.56}P_{16.62}Si_{1.38}$ | 378.1 | 419.6 | 41.5 | 834.9 | 869.4 |
| 68 | $Ni_{68.34}Cr_{9.62}Mn_{3.54}P_{17.08}Si_{1.42}$ | 380.1 | 439.6 | 59.5 | 834.4 | 872.5 |
| 69 | $Ni_{67.92}Cr_{9.56}Mn_{3.52}P_{17.54}Si_{1.46}$ | 382.2 | 446.9 | 64.7 | 832.5 | 872.2 |
| 70 | $Ni_{67.71}Cr_{9.53}Mn_{3.51}P_{17.77}Si_{1.48}$ | 386.5 | 449.4 | 62.9 | 831.7 | 881.9 |
| 55 | $Ni_{67.5}Cr_{9.5}Mn_{3.5}P_{18}Si_{1.5}$ | 384.4 | 445.5 | 61.1 | 830.3 | 881.2 |
| 72 | $Ni_{67.08}Cr_{9.44}Mn_{3.48}P_{18.46}Si_{1.54}$ | 386.2 | 444.6 | 58.4 | 829.8 | 881.9 |
| 73 | $Ni_{66.66}Cr_{9.38}Mn_{3.46}P_{18.92}Si_{1.58}$ | 393.6 | 444.7 | 51.1 | 830.4 | 897.4 |
| 74 | $Ni_{66.24}Cr_{9.32}Mn_{3.44}P_{19.38}Si_{1.62}$ | 396.8 | 443.6 | 46.8 | 830.3 | 877.2 |

Figure 30:
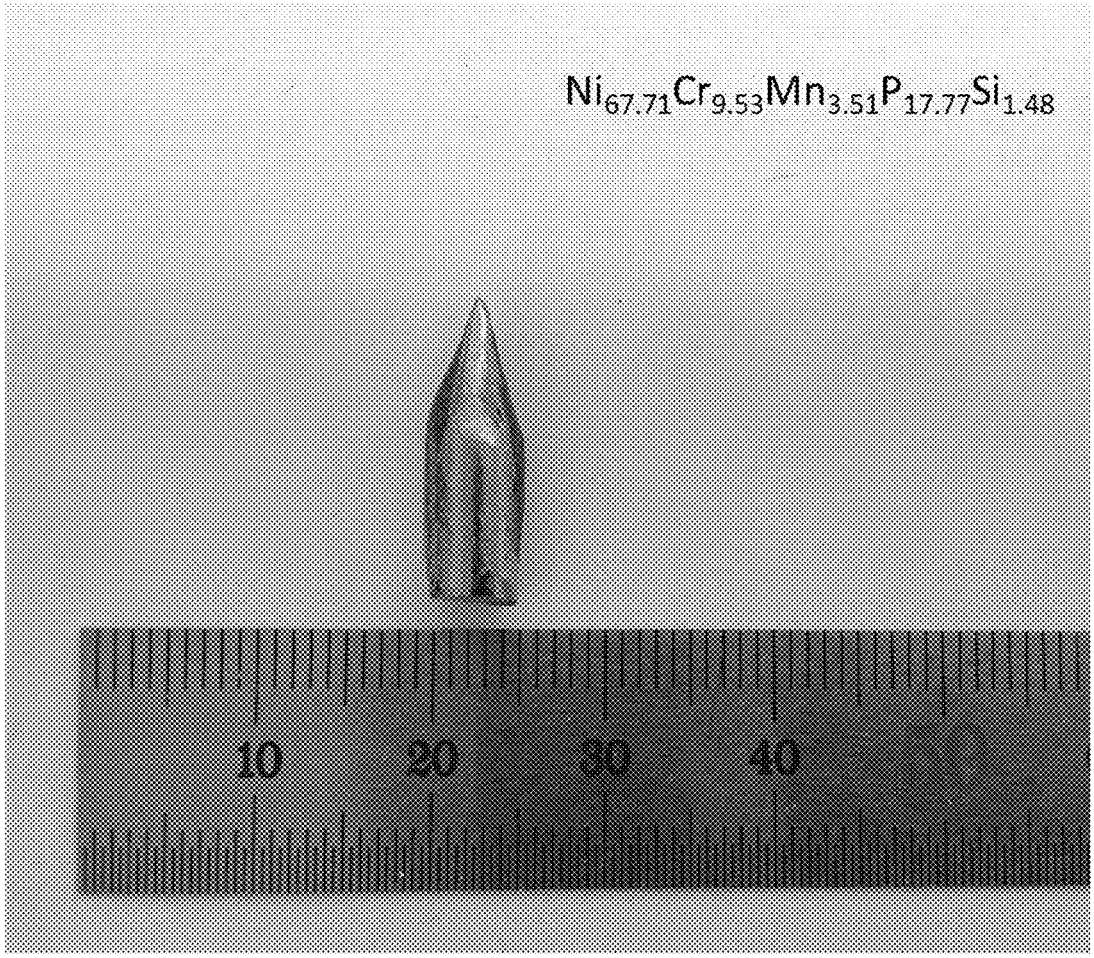
FIG. 30 provides an image of an amorphous 5 mm rod of example metallic glass $Ni_{67.71}Cr_{9.53}Mn_{3.51}P_{17.77}Si_{1.48}$ in accordance with embodiments of the disclosure.
Figure 31:
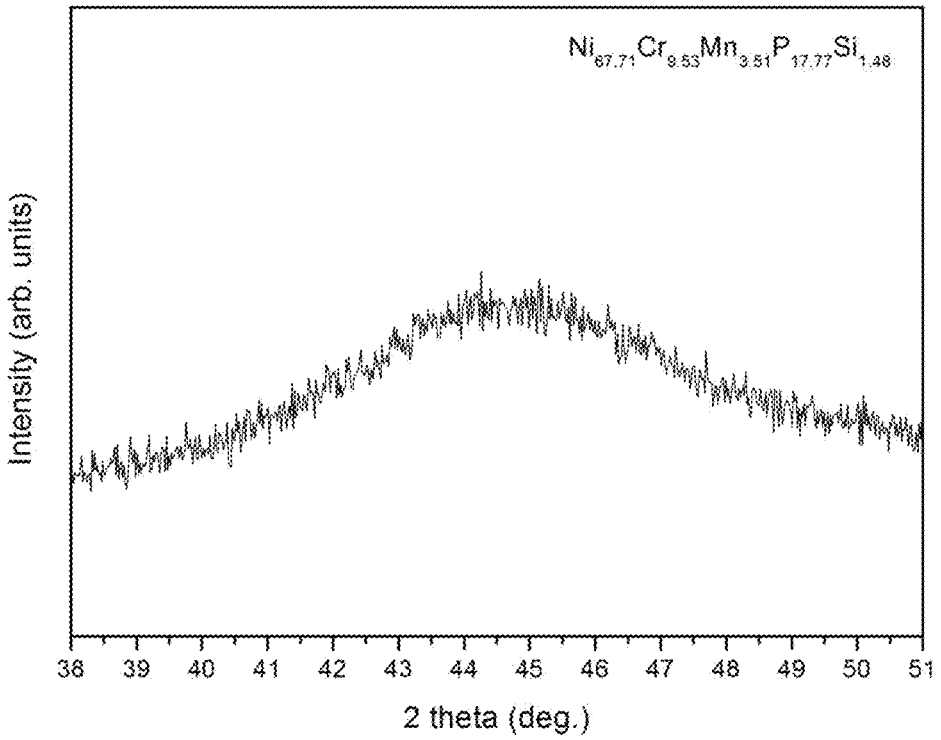
FIG. 31 provides an x-ray diffractogram verifying the amorphous structure of a 5 mm rod of example metallic glass $Ni_{67.71}Cr_{9.53}Mn_{3.51}P_{17.77}Si_{1.48}$ in accordance with embodiments of the disclosure.
Figure 32:
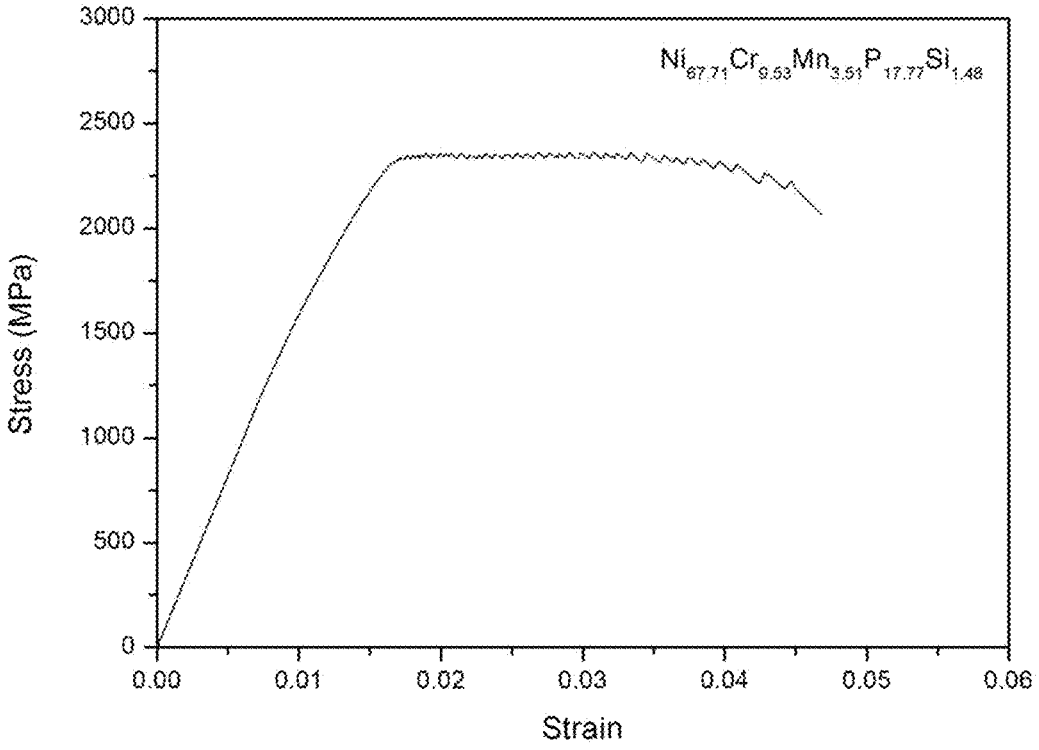
FIG. 32 provides a compressive stress-strain diagram for example metallic glass $Ni_{67.71}Cr_{9.53}Mn_{3.51}P_{17.77}Si_{1.48}$ in accordance with embodiments of the disclosure.

Among the alloy compositions investigated in this disclosure, one of the alloys exhibiting the highest glass-forming ability is Example 70, having composition $Ni_{67.71}Cr_{9.53}Mn_{3.51}P_{17.77}Si_{1.48}$, which has critical rod diameter of 5 mm and stability of the supercooled liquid against crystallization ΔT of 62.9° C. This alloy has a high notch toughness of 89.4 MPa $m^{1/2}$ and a high yield strength of 2362 MPa. The measured notch toughness and yield strength of sample metallic glass $Ni_{67.1}Cr_{10}Nb_{3.4}P_{18}Si_{1.5}$ are listed along with the critical rod diameter and stability of the supercooled liquid against crystallization in Table 15. An image of a 5 mm diameter amorphous $Ni_{67.71}Cr_{9.53}Mn_{3.51}P_{17.77}Si_{1.48}$ rod is shown in FIG. 30. An x-ray diffractogram taken on the cross section of a 5 mm diameter $Ni_{67.71}Cr_{9.53}Mn_{3.51}P_{17.77}Si_{1.48}$ rod verifying its amorphous structure is shown in FIG. 31. The stress-strain diagram for sample metallic glass $Ni_{67.71}Cr_{9.53}Mn_{3.51}P_{17.77}Si_{1.48}$ is presented in FIG. 32.

TABLE 15

Critical rod diameter, notch toughness, and yield strength of metallic glass $Ni_{67.71}Cr_{9.53}Mn_{3.51}P_{17.77}Si_{1.48}$

| Sample | Composition | Critical Rod Diameter [mm] | $\Delta T_x$ (° C.) | Notch Toughness [MPa $m^{1/2}$] | Yield Strength [MPa] |
|---|---|---|---|---|---|
| 29 | $Ni_{67.71}Cr_{9.53}Mn_{3.51}P_{17.77}Si_{1.48}$ | 5 | 62.9 | 89.4 ± 1.8 | 2362 |

Figure 33:
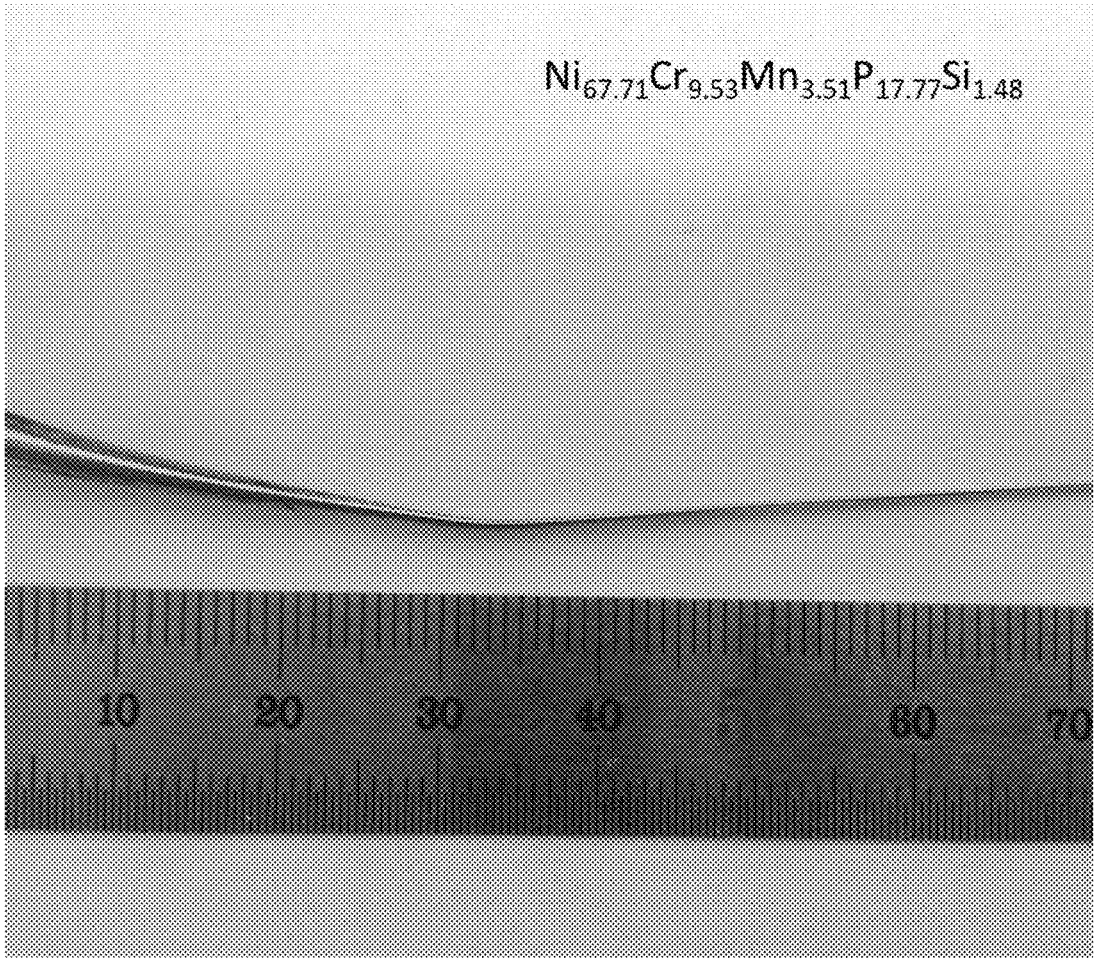
FIG. 33 provides an image of a plastically bent 1 mm amorphous rod of example metallic glass $Ni_{67.71}Cr_{9.53}Mn_{3.51}P_{17.77}Si_{1.48}$ in accordance with embodiments of the disclosure.

Lastly, the alloys according to the disclosure exhibit a remarkable bending ductility. Specifically, under an applied bending load, the alloys are capable of undergoing plastic bending in the absence of fracture for diameters up to at least 1 mm. An image of a metallic glass rod of example metallic glass $Ni_{67.71}Cr_{9.53}Mn_{3.51}P_{17.77}Si_{1.48}$ plastically bent at 1-mm diameter section is presented in FIG. 33.

Description of Methods of Processing the Sample Alloys

A method for producing the alloys involves inductive melting of the appropriate amounts of elemental constituents in a quartz tube under inert atmosphere. The purity levels of the constituent elements were as follows: Ni 99.995%, Cr 99.996%, Mn 99.9998%, Mo 99.95%, Nb 99.95%, P 99.9999%, and Si 99.9999%. Prior to producing an amorphous article from an alloy of the disclosure, the alloy ingots may be fluxed with a reducing agent such as boron oxide. A method for fluxing the alloy ingots involves re-melting the ingots in a quartz tube under inert atmosphere, bringing the alloy melt in contact with molten boron oxide and allowing the two melts to interact for about a time period of 1000 seconds at a temperature of about 1100° C. or higher, and subsequently water quenching. A method for producing metallic glass rods from the alloy ingots involves re-melting the ingots in quartz tubes of 0.5-mm thick walls in a furnace at 1100° C. or higher, and particularly between 1200° C. and 1400° C., under high purity argon and rapidly quenching in a room-temperature water bath.

In general, amorphous articles from the alloy of the disclosure can be produced by (1) re-melting the alloy ingots in quartz tubes having 0.5-mm thick walls, holding the melt at a temperature of about 1100° C. or higher, and particularly between 1200° C. and 1400° C., under inert atmosphere, and rapidly quenching in a liquid bath; or (2) re-melting the alloy ingots, holding the melt at a temperature of about 1100° C. or higher, and particularly between 1200° C. and 1400° C., under inert atmosphere, and injecting or pouring the molten alloy into a metal mold, particularly made of copper, brass, or steel.

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the disclosure. The following claims are intended to cover all generic and specific features described herein, as well as all statements of the scope of the present method and system, which, as a matter of language, might be said to fall therebetween.

Test Methodology for Measuring Notch Toughness

The notch toughness of sample metallic glasses was performed on 3 mm diameter rods. The rods were notched using a wire saw with a root radius of between 0.10 and 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Yield Strength

Compression testing of exemplary metallic glasses was performed on cylindrical specimens 3 mm in diameter and 6 mm in length by applying a monotonically increasing load at constant cross-head speed of 0.001 mm/s using a screw-driven testing frame. The strain was measured using a linear variable differential transformer. The compressive yield strength was estimated using the 0.2% proof stress criterion.

The alloys and metallic glasses described herein can be valuable in the fabrication of electronic devices. An electronic device herein can refer to any electronic device known in the art. For example, it can be a telephone, such as a mobile phone, and a landline phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the disclosure. Accordingly, the above description should not be taken as limiting the scope of the disclosure.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed:

1. An alloy capable of forming a metallic glass represented by the following formula (subscripts denote atomic percentages):

$$Ni_{(100-a-b-c-d)}Mn_aX_bP_cSi_d$$

where:

a is between 0.25 and 12, b is up to 20, c is between 14 and 22, d is between 0.25 and 5, and where X is selected from Cr, Mo, Nb, Ta, and combinations thereof or by the above formula and wherein:

i) up to 50 atomic percent of Ni is substituted by Co, ii) up to 30 atomic percent of Ni is substituted by Fe, iii) up to 10 atomic percent of Ni is substituted by Cu, or iv) up to 2 atomic percent of Ni is substituted by Ge, V, Sn, W, Ru, Re, Pd, Pt, or a combination thereof.

2. The alloy according to claim 1, wherein X is selected from Cr and Mo, and combinations thereof, and b is up to 18 percent.

3. The alloy according to claim 1, wherein X is selected from Nb and Ta, and combinations thereof, and b is up to 6 percent.

4. The alloy according to claim 1, wherein X is Mo and Nb.

5. The alloy according to claim 4, wherein the atomic concentration of Mo is between 0.5 and 4 atomic percent, and the critical rod diameter of the alloy is at least 1 mm.

6. The alloy according to claim 4, wherein the atomic concentration of Nb is between 2.5 and 5 atomic percent, and the critical rod diameter of the alloy is at least 2 mm.

7. The alloy according to claim 1, wherein X is Cr.

8. The alloy according to claim 7, wherein a is between 1 and 7, and the critical rod diameter of the alloy is at least 1 mm.

9. The alloy according to claim 7, wherein b is between 5 and 15, and the critical rod diameter of the alloy is at least 1 mm.

10. The alloy according to claim 7, wherein c is between 15 and 21, and the critical rod diameter of the alloy is at least 1 mm.

11. The alloy according to claim 7, wherein d is between 0.25 and 3, and the critical rod diameter of the alloy is at least 1 mm.

12. The alloy according to claim 1, wherein up to 50 atomic percent of Ni is substituted with Co.

13. The alloy according to claim 1, wherein up to 30 atomic percent of Ni is substituted by Fe.

14. The alloy according to claim 1, wherein up to 10 atomic percent of Ni is substituted by Cu.

15. The alloy according to claim 1, wherein the alloy further comprises Ge, V, Sn, W, Ru, Re, Pd, Pt, or a combination thereof at combined atomic concentration of up to 2 percent.

16. A metallic glass comprising an alloy, wherein a composition of the alloy is represented by the following formula (subscripts denote atomic percentages):

$$Ni_{(100-a-b-c-d)}Mn_aX_bP_cSi_d$$

where:

a is between 0.25 and 12, b is up to 20, c is between 14 and 22, d is between 0.25 and 5, and where X is selected from Cr, Mo, Nb, Ta, and combinations thereof.

17. A method of producing a metallic glass comprising:

melting an alloy into a molten state to form an alloy melt; where the alloy has a composition represented by the following formula (subscripts denote atomic percentages):

$$Ni_{(100-a-b-c-d)}Mn_aX_bP_cSi_d$$

where:

a is between 0.25 and 12, b is up to 20, c is between 14 and 22, d is between 0.25 and 5, where X is selected from Cr, Mo, Nb, Ta, and combinations thereof; and quenching the alloy melt at a cooling rate sufficiently rapid to prevent crystallization of the alloy.

18. The method of claim 17, further comprising fluxing the alloy melt with a reducing agent prior to quenching.

19. The method of claim 17, wherein the temperature of the alloy melt prior to quenching is at least 1100° C.

20. The method of claim 17, wherein the temperature of the alloy melt prior to quenching is at least 100° C. above the liquidus temperature of the alloy.

* * * * *